US009683585B2

(12) United States Patent
Akiyama et al.

(10) Patent No.: US 9,683,585 B2
(45) Date of Patent: Jun. 20, 2017

(54) HYDRAULIC DRIVE SYSTEM

(75) Inventors: Teruo Akiyama, Kokubunji (JP); Noboru Iida, Chigasaki (JP); Koji Saito, Fujisawa (JP); Takayuki Watanabe, Hiratsuka (JP); Koji Yamashita, Yokohama (JP)

(73) Assignee: KOMATSU LTD., Tokyo (JP)

( * ) Notice: Subject to any disclaimer, the term of this patent is extended or adjusted under 35 U.S.C. 154(b) by 553 days.

(21) Appl. No.: 14/129,387

(22) PCT Filed: Aug. 13, 2012

(86) PCT No.: PCT/JP2012/070603
§ 371 (c)(1),
(2), (4) Date: Dec. 26, 2013

(87) PCT Pub. No.: WO2013/027620
PCT Pub. Date: Feb. 28, 2013

(65) Prior Publication Data

US 2014/0130487 A1 May 15, 2014

(30) Foreign Application Priority Data

Aug. 24, 2011 (JP) ..... 2011-182938

(51) Int. Cl.
*F15B 11/042* (2006.01)
*E02F 9/22* (2006.01)
*F15B 11/04* (2006.01)

(52) U.S. Cl.
CPC ..... *F15B 11/0423* (2013.01); *E02F 9/2217* (2013.01); *E02F 9/2228* (2013.01);
(Continued)

(58) Field of Classification Search
CPC ..... F15B 11/046; F15B 11/048; F15B 2211/2056; E02F 9/2235; E02F 9/2289;
(Continued)

(56) References Cited

U.S. PATENT DOCUMENTS 5,513,551 A * 5/1996 Morishita ..... F15B 21/087 91/459
7,543,449 B2 * 6/2009 Ivantysynova ..... F15B 7/006 60/464

(Continued)

FOREIGN PATENT DOCUMENTS

CN 1754420 A 4/2006
JP 58-43537 B2 9/1983

(Continued)

OTHER PUBLICATIONS

Swing Hydraulic Circuit of the Crane (JP 9208187, machine translation to English by WIPO and Google, retrieved on Mar. 28, 2016 <URL: https://patentscope.wipo.int/>).*

(Continued)

*Primary Examiner* — F. Daniel Lopez
*Assistant Examiner* — Richard Drake
(74) *Attorney, Agent, or Firm* — Global IP Counselors, LLP

(57) ABSTRACT

A hydraulic driving system includes a hydraulic pump, a driving source, a hydraulic cylinder, a closed circuit hydraulic path between the pump and cylinder, a pump-flow-rate control unit controlling a discharge flow rate of the pump, a flow rate control valve between the pump and the cylinder in the fluid path, a directional control unit, a target flow rate setting unit and a control device. The directional control unit allows a flow of fluid from the pump to the cylinder and prohibits a flow of fluid from the cylinder to the pump when fluid is supplied from the pump to the cylinder via the flow rate control valve. The control device controls fluid flow to the cylinder with the flow rate control valve when the target flow rate is within a prescribed range, and with the pump-flow-rate control unit when the target flow rate is greater than the prescribed range.

15 Claims, 12 Drawing Sheets

(52) U.S. Cl.
CPC ..... *E02F 9/2232* (2013.01); *E02F 9/2285* (2013.01); *E02F 9/2289* (2013.01); *E02F 9/2292* (2013.01); *E02F 9/2296* (2013.01); *F15B 11/0413* (2013.01); *F15B 2211/20546* (2013.01); *F15B 2211/20561* (2013.01); *F15B 2211/20576* (2013.01); *F15B 2211/27* (2013.01); *F15B 2211/613* (2013.01); *F15B 2211/633* (2013.01); *F15B 2211/6346* (2013.01); *F15B 2211/7053* (2013.01); *F15B 2211/785* (2013.01)

(58) Field of Classification Search
CPC ..... E02F 9/2292; E02F 9/2296; E02F 3/42; F16H 61/4017; F16H 61/4061
See application file for complete search history.

(56) References Cited

U.S. PATENT DOCUMENTS 8,033,107 B2 * 10/2011 Tikkanen ..... F15B 7/006 60/464
8,708,679 B2 * 4/2014 Mathers ..... 417/410.3
2010/0332102 A1 * 12/2010 Akiyama ..... E02F 9/2232 701/99

FOREIGN PATENT DOCUMENTS

| | | | |
|---|---|---|---|
| JP | 9-208187 | A | 8/1997 |
| JP | 2002-195209 | A | 7/2002 |
| JP | 2009-511831 | A | 3/2009 |
| JP | 2009-121649 | A | 6/2009 |
| WO | 2011/046184 | A1 | 4/2011 |

OTHER PUBLICATIONS

JP 58-043537B (Detailed Description, machine translation to English provided by JPO and INPIT, retrieved on Mar. 30, 2016 <URL: https://www4.j-platpat.inpit.go.jp>.*
The Office Action for the corresponding Chinese patent application No. 201280041182.6, issued on May 5, 2015.
International Search Report for PCT/JP2012/070603, issued on Nov. 13, 2012.
The Office Action for the corresponding German application No. 11 2012 003 500.3, issued on Dec. 1, 2016.

* cited by examiner

HYDRAULIC DRIVE SYSTEM

CROSS-REFERENCE TO RELATED APPLICATIONS

This application is a U.S. National stage application of International Application No. PCT/JP2012/070603, filed on Aug. 13, 2012. This U.S. National stage application claims priority under 35 U.S.C. §119(a) to Japanese Patent Application No. 2011-182938, filed in Japan on Aug. 24, 2011, the entire contents of which are hereby incorporated herein by reference.

BACKGROUND

Field of the Invention

The present invention relates to a hydraulic drive system.

Background Information

Work machines such as a hydraulic excavator or a wheel loader are equipped with working instrument driven by a hydraulic cylinder. Hydraulic fluid discharged from a hydraulic pump is supplied to the hydraulic cylinder. The hydraulic fluid is supplied via a hydraulic circuit to the hydraulic cylinder. For example, Japan Patent Laid-open Patent Publication JP-A-2009-511831 describes a work machine equipped with a hydraulic closed circuit for supplying hydraulic fluid to the hydraulic cylinder. Potential energy of the working instrument is regenerated due to the hydraulic circuit being a closed circuit. As a result, fuel consumption of a motor for driving the hydraulic pump can be reduced.

SUMMARY

The work machine performs control work on the working instrument at very small speeds. For example, when performing hoisting with a hydraulic excavator, the control of the boom needs to be performed at very small speeds to position a load. The flow rate of the hydraulic fluid supplied to the hydraulic cylinders of the working instrument needs to be controlled within very small flow rate ranges when controlling the working instrument at very small speeds. For example, the flow rate needs to be controlled in units of 1% or less of the maximum flow rate of the hydraulic pump.

Precise control of the discharge flow rate of the hydraulic pump is required in the hydraulic closed circuit as disclosed in the abovementioned Japan Patent Laid-open Patent Publication JP-A-2009-511831 in order to control the flow rate of the hydraulic fluid supplied to the hydraulic cylinders for the working instrument within a very small flow rate range. However, there is a limit to the minimum controllable flow rate of the discharge flow rate of the hydraulic pump and thus it is difficult to control the discharge flow rate of the hydraulic pump in a precise manner as described above.

For example, the discharge flow rate of the hydraulic pump becomes smaller by making the tilt angle of the hydraulic pump smaller when a variable displacement hydraulic pump is used. However, it is difficult to achieve a stable discharge flow rate in the region of a very small tilt angle since the impact of variations in hydraulic fluid leakage from the sliding portion of the hydraulic pump becomes greater. Moreover, since a friction force acts on the mechanism for varying the tilt angle of the hydraulic pump, it is difficult to control the tilt angle of the hydraulic pump in very small angle units.

For example, the discharge flow rate of the hydraulic pump is reduced by making the rotation speed of the hydraulic pump smaller when a fixed displacement hydraulic pump is used. However, it is difficult to achieve a stable discharge flow rate in the region of a very small rotation speed since the impact of variations in hydraulic fluid leakage from the sliding portion of the hydraulic pump becomes greater.

An object of the present invention is to enable micro-speed control of a hydraulic cylinder in a hydraulic drive system equipped with a hydraulic closed circuit.

A hydraulic drive system according to a first aspect of the present invention includes a hydraulic pump, a driving source, a hydraulic cylinder, a hydraulic fluid path, a pump-flow-rate control unit, a flow rate control valve, a directional control unit, a target flow rate setting unit, and a control device. The driving source drives the hydraulic pump. The hydraulic cylinder is driven by hydraulic fluid discharged from the hydraulic pump. The hydraulic fluid path configures a closed circuit between the hydraulic pump and the hydraulic cylinder. The pump-flow-rate control unit controls a discharge flow rate of the hydraulic pump. The flow rate control valve is disposed between the hydraulic pump and the hydraulic cylinder in the hydraulic fluid path. The flow rate control valve controls the flow rate of the hydraulic fluid supplied from the hydraulic pump to the hydraulic cylinder. The directional control unit allows the flow of the hydraulic fluid from the hydraulic pump to the hydraulic cylinder and prohibits the flow of the hydraulic fluid from the hydraulic cylinder to the hydraulic pump when the hydraulic fluid is supplied from the hydraulic pump to the hydraulic cylinder via the flow rate control valve. The target flow rate setting unit sets a target flow rate of the hydraulic fluid supplied to the hydraulic cylinder. When the target flow rate is within a prescribed range, the control device uses the flow rate control valve to control the flow rate of the hydraulic fluid being supplied to the hydraulic cylinder. When the target flow rate is above the aforementioned prescribed range, the control device uses the pump-flow-rate control unit to control the flow rate of the hydraulic fluid being supplied to the hydraulic cylinder.

A hydraulic drive system according to a second aspect of the present invention is related to the hydraulic drive system of the first aspect, wherein the control device fully opens the opening degree of the path in the flow rate control valve to allow communication between the hydraulic pump and the hydraulic cylinder when the target flow rate is greater than the prescribed range.

A hydraulic drive system according to a third aspect of the present invention is related to the hydraulic drive system of the first aspect, wherein the hydraulic fluid path has an adjustment path to which hydraulic fluid for the hydraulic pump is supplied. When the target flow rate is within the prescribed range, the discharge flow rate of the hydraulic pump is set to be greater than the target flow rate and the hydraulic fluid from the hydraulic pump is supplied by being divided between the hydraulic cylinder and the adjustment path.

A hydraulic drive system according to a fourth aspect of the present invention is related to the hydraulic drive system of the third aspect, wherein, when the target flow rate is greater than the prescribed range, the discharge flow rate of the hydraulic pump is set to the target flow rate and the path between the adjustment path and the hydraulic pump in the hydraulic fluid path is closed.

A hydraulic drive system according to a fifth aspect of the present invention is related to the hydraulic drive system of the third aspect, wherein the flow rate control valve controls a flow rate of the hydraulic fluid supplied from the hydraulic pump to the hydraulic cylinder and a flow rate of the hydraulic fluid supplied from the hydraulic pump to the adjustment path.

A hydraulic drive system according to a sixth aspect of the present invention is related to the hydraulic drive system of the fifth aspect, wherein the hydraulic fluid path further includes a pump path and a cylinder path. The pump path is connected to the hydraulic pump. The cylinder path is connected to the hydraulic cylinder. The flow rate control valve has a pump port, a cylinder port, and an adjustment port. The pump port is connected to the pump path via the directional control unit. The cylinder port is connected to the cylinder path. The adjustment port is connected to the adjustment path.

A hydraulic drive system according to a seventh aspect of the present invention is related to the hydraulic drive system of the third aspect, and further includes an adjustment flow rate control unit. The adjustment flow rate control unit controls the flow rate of the hydraulic fluid supplied from the hydraulic pump to the adjustment path. The hydraulic fluid path further includes a pump path, a cylinder path, and a pilot path. The pump path is connected to the hydraulic pump. The cylinder path is connected to the hydraulic cylinder. The pilot path is connected to a pilot port in the adjustment flow rate control unit. The adjustment flow rate control unit allows communication between the pump path and the adjustment path when a differential hydraulic pressure between the pump path and the pilot path is greater than a prescribed set pressure. The adjustment flow rate control unit shuts off communication between the pump path and the adjustment path when the differential hydraulic pressure between the pump path and the pilot path is equal to or less than the prescribed set pressure. The flow rate control valve connects the pump path and the cylinder path and connects the cylinder path and the pilot path. The differential hydraulic pressure between the pump path and the cylinder path when the target flow rate is within the prescribed range is greater than the prescribed set pressure. The differential hydraulic pressure between the pump path and the cylinder path when the target flow rate is greater than the prescribed range is equal to or less than the prescribed set pressure.

A hydraulic drive system according to an eighth aspect of the present invention is related to the hydraulic drive system of the third aspect, and further includes the adjustment flow rate control unit. The adjustment flow rate control unit controls the flow rate of the hydraulic fluid supplied from the hydraulic pump to the adjustment path. The hydraulic fluid path further includes a pump path, a cylinder path, and a pilot path. The pump path is connected to the hydraulic pump. The cylinder path is connected to the hydraulic cylinder. The pilot path is connected to a pilot port on the adjustment flow rate control unit. The adjustment flow rate control unit allows communication between the pump path and the adjustment path when a differential hydraulic pressure between the pump path and the pilot path is greater than a prescribed set pressure. The adjustment flow rate control unit shuts off communication between the pump path and the adjustment path when the differential hydraulic pressure between the pump path and the pilot path is equal to or less than the prescribed set pressure. The differential hydraulic pressure between the pump path and the cylinder path when the target flow rate is within the prescribed range is greater than the prescribed set pressure. The flow rate control valve connects the pump path and the cylinder path and connects the cylinder path and the pilot path when the target flow rate is within the prescribed range. The flow rate control valve connects the pump path and the cylinder path and connects the pilot path and the pump path when the target flow rate is greater than the prescribed range.

A hydraulic drive system according to a ninth aspect of the present invention is related to the hydraulic drive system of the third aspect, and further includes an adjustment flow rate control unit. The adjustment flow rate control unit controls the flow rate of the hydraulic fluid supplied from the hydraulic pump to the adjustment path. The hydraulic fluid path further includes a pump path, a cylinder path, and a pilot path. The pump path is connected to the hydraulic pump. The cylinder path is connected to the hydraulic cylinder. The pilot path is connected to the cylinder path and the pilot port in the adjustment flow rate control unit. The adjustment flow rate control unit allows communication between the pump path and the adjustment path when a differential hydraulic pressure between the pump path and the pilot path is greater than a prescribed set pressure. The adjustment flow rate control unit shuts off communication between the hydraulic pump and the adjustment path when the differential hydraulic pressure between the pump path and the pilot path is equal to or less than the prescribed set pressure. The differential hydraulic pressure between the pump path and the cylinder path when the target flow rate is within the prescribed range is greater than the prescribed set pressure. The differential hydraulic pressure between the pump path and the cylinder path when the target flow rate is greater than the prescribed range is equal to or less than the prescribed set pressure.

A hydraulic drive system according to a tenth aspect of the present invention is related to the hydraulic drive system of the ninth aspect, wherein the flow rate control valve shuts off communication between the pump path and the cylinder path and connects the pump path to the adjustment path in a neutral position state.

A hydraulic drive system according to an eleventh aspect of the present invention is related to the hydraulic drive system of the tenth aspect, wherein, when an opening of the flow rate control valve between the pump path and the cylinder path is open, an opening between the pump path and the adjustment path is closed.

A hydraulic drive system according to a twelfth aspect of the present invention is related to any one of the third to eleventh aspects, and further includes a charge pump for replenishing hydraulic fluid to the hydraulic pump. The hydraulic fluid path further includes a charge path connecting the charge pump and the hydraulic pump. The adjustment path is connected to the charge path.

A hydraulic drive system according to a thirteenth aspect of the present invention is related to the seventh aspect, and further includes a charge pump for replenishing hydraulic fluid to the hydraulic pump. The hydraulic fluid path further includes a charge path connecting the charge pump and the hydraulic pump. The flow rate control valve shuts off communication between the pump path and the cylinder path and connects the pilot path to the charge path in the neutral position state.

A hydraulic drive system according to a fourteenth aspect of the present invention is related to any one of the third to eleventh aspects, and further includes a hydraulic fluid tank for storing the hydraulic fluid. The adjustment path is connected to the hydraulic fluid tank.

A hydraulic drive system according to a fifteenth aspect of the present invention is related to the first aspect, wherein the hydraulic pump is a variable displacement pump. The pump-flow-rate control unit controls the discharge flow rate of the hydraulic pump by controlling a tilt angle of the hydraulic pump. The target flow rate setting unit is an operating member operated by an operator. When an operation amount of the operating member is zero, the control device sets the tilt angle of the hydraulic pump to zero. When the operation amount of the operating member is within a prescribed operation range corresponding to the prescribed range of the target flow rate, the control device controls the tilt angle of the hydraulic pump so that the discharge flow rate of the hydraulic pump meets or exceeds the target flow rate corresponding to the operation amount of the operating member.

A hydraulic drive system according to a sixteenth aspect of the present invention is related to the first aspect, wherein pump-flow-rate control unit controls the discharge flow rate of the hydraulic pump by controlling a rotation speed of the hydraulic pump. The target flow rate setting unit is an operating member operated by an operator. When the operation amount of the operating member is zero, the control device stops the rotation of the hydraulic pump. When the operation amount of the operating member is within a prescribed operation range corresponding to the prescribed range of the target flow rate, the control device controls the rotation speed of the hydraulic pump so that the discharge flow rate of the hydraulic pump meets or exceeds the target flow rate corresponding to the operation amount of the operating member.

A hydraulic drive system according to a seventeenth aspect of the present invention is related to the first aspect, wherein the hydraulic pump has a first pump port and a second pump port. The hydraulic pump is switchable between a state of drawing in hydraulic fluid from the second pump port and discharging hydraulic fluid from the first pump port, and a state of drawing in hydraulic fluid from the first pump port and discharging hydraulic fluid from the second pump port. The hydraulic cylinder has a first chamber and a second chamber. The hydraulic cylinder expands and contracts by switching between the supply and exhaust of hydraulic fluid to and from the first chamber and the second chamber. The hydraulic fluid path has a first pump path, a second pump path, a first cylinder path, and a second cylinder path. The first pump path is connected to the first pump port. The second pump path is connected to the second pump port. The first cylinder path is connected to the first chamber. The second cylinder path is connected to the second chamber. The directional control unit has a first directional control unit and a second directional control unit. The first directional control unit allows the flow of hydraulic fluid from the first pump path to the first cylinder path and prohibits the flow of hydraulic fluid from the first cylinder path to the first pump path when hydraulic fluid is supplied to the first cylinder path from the first pump path by the flow rate control valve. The second directional control unit allows the flow of hydraulic fluid from the second pump path to the second cylinder path and prohibits the flow of hydraulic fluid from the second cylinder path to the second pump path when hydraulic fluid is supplied to the second cylinder path from the second pump path by the flow rate control valve. The flow rate control valve is switchable between a first position state and a second position state. The flow rate control valve connects the first pump path to the first cylinder path via the first directional control unit and connects the second cylinder path to the second pump path while bypassing the second directional control unit in the first position state. The flow rate control valve connects the first cylinder path to the first pump path while bypassing the first directional control unit and connects the second pump path to the second cylinder path via the second directional control unit in the second position state.

When the target flow rate is within a prescribed range, the control device in the hydraulic drive system according to the first aspect of the present invention uses the flow rate control valve to control the flow rate of the hydraulic fluid being supplied to the hydraulic cylinder. Therefore, when the target flow rate is a very small flow rate, the flow rate of the hydraulic fluid supplied to the hydraulic cylinder is controlled by the flow rate control valve. As a result, the flow rate of the hydraulic fluid being supplied to the hydraulic cylinder is able to be controlled by the flow rate control valve as a very small flow rate even if the minimum controllable flow rate of the discharge flow rate from the hydraulic pump controlled by the pump-flow-rate control unit is not small enough to allow control as a very small flow rate. Consequently, micro-speed control of the hydraulic cylinder is possible.

When the target flow rate is above the prescribed range, the flow rate of the hydraulic fluid being supplied to the hydraulic cylinder is controlled by the pump-flow-rate control unit. Therefore, when the target flow rate is not a very small flow rate, the flow rate of the hydraulic fluid supplied to the hydraulic cylinder is controlled by controlling the discharge flow rate of the hydraulic pump. While energy loss of the flow rate control valve increases when hydraulic fluid having a large flow rate is controlled by the flow rate control valve, the occurrence of such an energy loss can be suppressed in the hydraulic drive system according to the present aspect.

Moreover, the flow directional control unit allows the flow of the hydraulic fluid from the hydraulic pump to the hydraulic cylinder and prohibits the flow of the hydraulic fluid from the hydraulic cylinder to the hydraulic pump when the hydraulic fluid is supplied from the hydraulic pump to the hydraulic cylinder via the flow rate control valve. As a result, a stroke amount of the hydraulic cylinder can be held in a very small operation. For example, when hoisting the boom a slight amount, a drop in the boom due to a reverse flow of the hydraulic fluid from the hydraulic cylinder can be prevented.

The opening degree of the path in the flow rate control valve is fully open when the target flow rate is greater than the prescribed range in the hydraulic drive system according to the second aspect of the present invention. As a result, pressure loss of the hydraulic fluid in the flow rate control valve can be suppressed and energy loss can be suppressed.

Hydraulic fluid having a flow rate greater than the target flow rate is discharged from the hydraulic pump when the target flow rate is within the prescribed range in the hydraulic drive system according to the third aspect of the present invention. A portion of the hydraulic fluid is supplied to the hydraulic cylinder via the flow rate control valve. As a result, the hydraulic fluid supplied to the hydraulic cylinder can be controlled to within a very small flow rate. Excess hydraulic fluid not supplied to the hydraulic cylinder is supplied to the adjustment path.

When the target flow rate is greater than the prescribed range, the discharge flow rate of the hydraulic pump is set to the target flow rate and the path between the adjustment path and the hydraulic pump in the hydraulic fluid path is closed in the hydraulic drive system according to a fourth aspect of the present invention. As a result, when the target flow rate is above the prescribed range, the flow rate of the hydraulic fluid being supplied to the hydraulic cylinder is controlled by the pump-flow-rate control unit.

The flow rate of the hydraulic fluid supplied from the hydraulic pump to the hydraulic cylinder and the flow rate of the hydraulic fluid supplied from the hydraulic pump to the adjustment path are both controlled by the flow rate control valve in the hydraulic drive system according to a fifth aspect of the present invention. As a result, the control of the flow rate of the hydraulic fluid supplied from the hydraulic pump to the hydraulic cylinder and the control of the flow rate of the hydraulic fluid supplied from the hydraulic pump to the adjustment path can be easily coordinated by the flow rate control valve.

The pump path, the cylinder path, and the adjustment path are connected to the flow rate control valve in the hydraulic drive system according to the sixth aspect of the present invention. As a result, the control of the flow rate of the hydraulic fluid supplied from the hydraulic pump to the hydraulic cylinder and the control of the flow rate of the hydraulic fluid supplied from the hydraulic pump to the adjustment path can be easily coordinated by the flow rate control valve.

The differential hydraulic pressure between the pump path and the cylinder path when the target flow rate is within the prescribed range is greater than the prescribed set pressure in the hydraulic drive system according to the seventh aspect of the present invention. Therefore, the adjustment flow rate control unit allows communication between the pump path and the adjustment path when the target flow rate is within the prescribed range. As a result, excess hydraulic fluid not supplied to the hydraulic cylinder is fed to the adjustment path. Moreover, the differential hydraulic pressure between the pump path and the cylinder path when the target flow rate is greater than the prescribed range is equal to or less than the prescribed set pressure. Therefore, the adjustment flow rate control unit shuts off communication between the pump path and the adjustment path when the target flow rate is greater than the prescribed range. As a result, the occurrence of energy loss can be suppressed by feeding a portion of the hydraulic fluid to the adjustment path.

The differential hydraulic pressure between the pump path and the cylinder path when the target flow rate is within the prescribed range is greater than the prescribed set pressure in the hydraulic drive system according to the eighth aspect of the present invention. Therefore, the adjustment flow rate control unit allows communication between the pump path and the adjustment path when the target flow rate is within the prescribed range. As a result, excess hydraulic fluid not supplied to the hydraulic cylinder is fed to the adjustment path. Moreover, the flow rate control valve connects the pump path and the cylinder path and connects the pilot path and the pump path when the target flow rate is greater the prescribed range. Therefore, since the differential hydraulic pressure between the pilot path and the pump path becomes zero, the adjustment flow rate control unit shuts off communication between the pump path and the adjustment path. As a result, the occurrence of energy loss can be suppressed by feeding a portion of the hydraulic fluid to the adjustment path.

The differential hydraulic pressure between the pump path and the cylinder path when the target flow rate is within the prescribed range is greater than the prescribed set pressure in the hydraulic drive system according to the ninth aspect of the present invention. Therefore, the adjustment flow rate control unit allows communication between the pump path and the adjustment path when the target flow rate is within the prescribed range. As a result, excess hydraulic fluid not supplied to the hydraulic cylinder is fed to the adjustment path. Moreover, the differential hydraulic pressure between the pump path and the cylinder path when the target flow rate is greater than the prescribed range is equal to or less than the prescribed set pressure. Therefore, the adjustment flow rate control unit shuts off communication between the pump path and the adjustment path when the target flow rate is greater than the prescribed range. As a result, the occurrence of energy loss can be suppressed by feeding a portion of the hydraulic fluid to the adjustment path. Moreover, since the pilot path is connected to the cylinder path and the pilot port in the adjustment flow rate control unit, there is no need to provide a port in the flow rate control valve for connecting to the pilot port. As a result, the flow rate control valve can be made in a compact manner.

The flow rate control valve connects the pump path to the adjustment path in a neutral position state in the hydraulic drive system according to a tenth aspect of the present invention. As a result, the occurrence of high pressure in the pump path can be suppressed even if a holding pressure of the hydraulic cylinder acts on the pilot port of the adjustment flow rate control unit via the cylinder path.

A variation in the speed of the hydraulic cylinder during micro-speed control can be minimized since the micro-speed control of the hydraulic cylinder is performed by the adjustment flow rate control unit in the hydraulic drive system according to the eleventh aspect of the present invention.

Excess hydraulic fluid is fed to the charge path when the target flow rate is within the prescribed range in the hydraulic drive system according to the twelfth aspect of the present invention.

Pressure in the pump path does not rise to or above a hydraulic pressure determined by the adjustment flow rate control unit and the hydraulic pressure of the charge path since the pilot path is connected to the charge path in the hydraulic drive system according to the thirteenth aspect of the present invention. Therefore, the occurrence of high pressure in the pump path can be suppressed even if the discharge flow rate of the hydraulic pump does not return to zero when the flow rate control valve is in the neutral position state.

Excess hydraulic fluid is fed to the hydraulic fluid tank when the target flow rate is within the prescribed range in the hydraulic drive system according to the fourteenth aspect of the present invention.

The discharge flow rate of the hydraulic pump is controlled to a flow rate equal to or above the target flow rate by controlling the tilt angle of the hydraulic pump when the target flow rate is within the prescribed range in the hydraulic drive system according to the fifteenth aspect of the present invention. As a result, the flow rate of the hydraulic fluid supplied to the hydraulic cylinder can be adjusted by the flow rate control valve and the flow rate of the hydraulic fluid to the hydraulic cylinder can be controlled with more accuracy. Moreover, while hydraulic fluid having a flow rate greater than the flow rate necessary for the hydraulic cylinder is discharged from the hydraulic pump, energy loss is small since the flow rate discharged from the hydraulic pump is originally small when the target flow rate is within the prescribed range.

The discharge flow rate of the hydraulic pump is controlled as a flow rate equal to or above the target flow rate by controlling the rotation speed of the hydraulic pump when the target flow rate is within the prescribed range in the hydraulic drive system according to the sixteenth aspect of the present invention. As a result, the flow rate of the hydraulic fluid supplied to the hydraulic cylinder can be adjusted by the flow rate control valve and the flow rate of the hydraulic fluid to the hydraulic cylinder can be controlled with more accuracy. Moreover, while hydraulic fluid having a flow rate greater than the flow rate necessary for the hydraulic cylinder is discharged from the hydraulic pump, energy loss is small since the flow rate discharged from the hydraulic pump is originally small when the target flow rate is within the prescribed range.

Hydraulic fluid discharged from the hydraulic pump is supplied to the first chamber of the hydraulic cylinder and the hydraulic fluid is recovered from the second chamber of the hydraulic cylinder when the flow rate control valve is in the first position state in the hydraulic drive system according to the seventeenth aspect of the present invention. Moreover, the reverse flow of hydraulic fluid from the first chamber is prevented by the first directional control unit. When the flow rate control valve is in the second position state, hydraulic fluid discharged from the hydraulic pump is supplied to the second chamber of the hydraulic cylinder and hydraulic fluid is recovered from the first chamber of the hydraulic cylinder. Moreover, the reverse flow of hydraulic fluid from the second chamber is prevented by the second directional control unit.

DETAILED DESCRIPTION OF EMBODIMENT(S)

A hydraulic drive system according to embodiments of the present invention shall be explained in detail with reference to the figures.

1. First Embodiment

Figure 1:
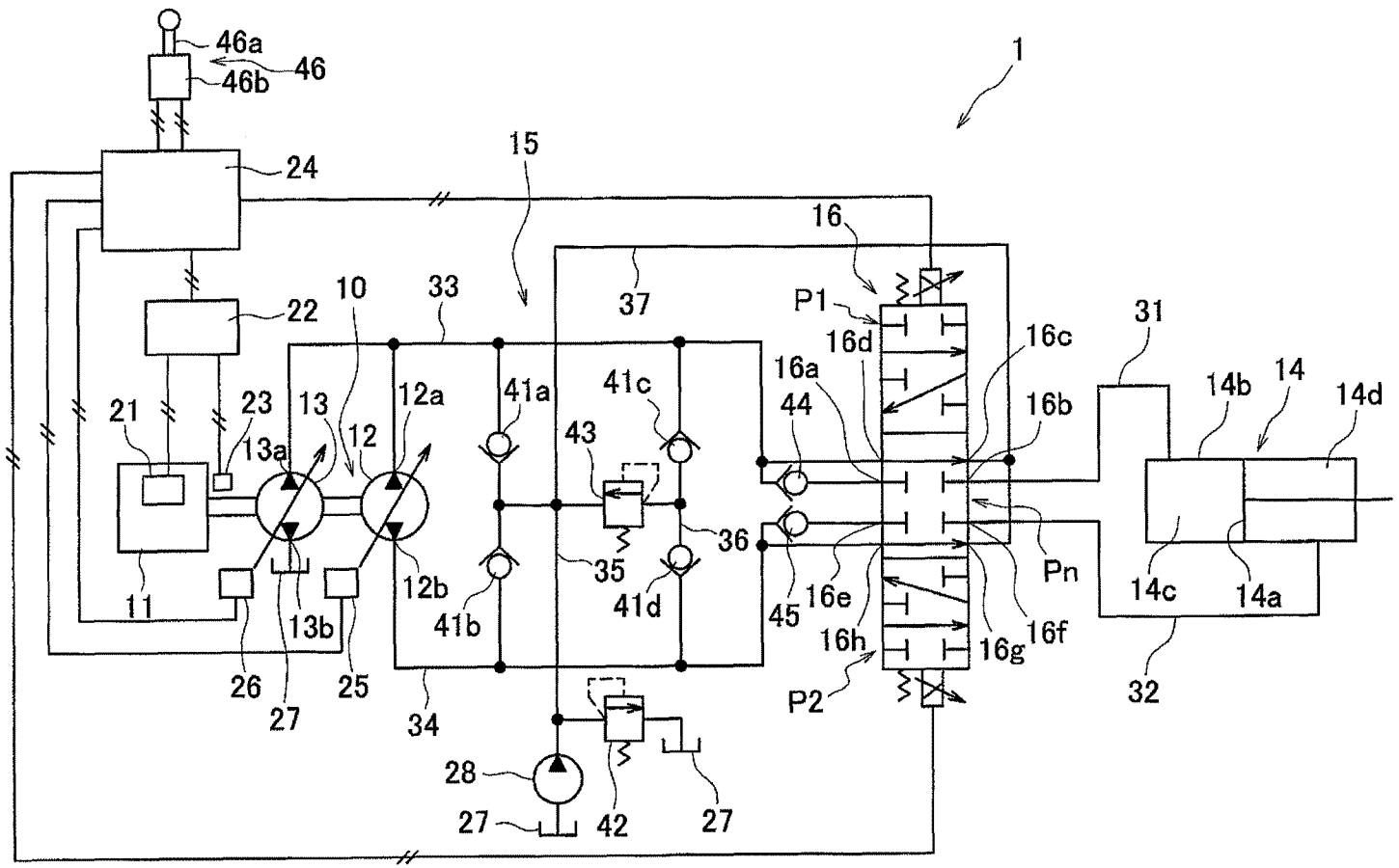
FIG. 1 is a block diagram of a configuration of a hydraulic drive system according to a first embodiment of the present invention.

FIG. 1 is a block diagram of a configuration of a hydraulic drive system 1 according to a first embodiment of the present invention. The hydraulic drive system 1 is installed on a work machine such as a hydraulic excavator, a wheel loader, or a bulldozer. The hydraulic drive system 1 includes an engine 11, a main pump 10, a hydraulic cylinder 14, a hydraulic fluid path 15, a flow rate control valve 16, and a pump controller 24.

The engine 11 drives a first hydraulic pump 12 and a second hydraulic pump 13. The engine 11 is an example of a driving source in the present invention. The engine 11 is a diesel engine, for example, and the output of the engine 11 is controlled by adjusting an injection amount of fuel from a fuel injection device 21. The adjustment of the fuel injection amount is performed by the engine controller 22 controlling the fuel injection device 21. An actual rotation speed of the engine 11 is detected by a rotation speed sensor 23, and a detection signal is input into the engine controller 22 and the pump controller 24.

The main pump 10 includes the first hydraulic pump 12 and the second hydraulic pump 13. The first hydraulic pump 12 and the second hydraulic pump 13 are driven by the engine 11 to discharge hydraulic fluid. The hydraulic fluid discharged from the main pump 10 is supplied to the hydraulic cylinder 14 via the flow rate control valve 16.

The first hydraulic pump 12 is a variable displacement hydraulic pump. The discharge flow rate of the first hydraulic pump 12 is controlled by controlling a tilt angle of the first hydraulic pump 12. The tilt angle of the first hydraulic pump 12 is controlled by a first pump-flow-rate control unit 25. The first pump-flow-rate control unit 25 controls the discharge flow rate of the first hydraulic pump 12 by controlling the tilt angle of the first hydraulic pump 12 on the basis of a command signal from the pump controller 24. The first hydraulic pump 12 is a two-directional discharge hydraulic pump. Specifically, the first hydraulic pump 12 has a first pump port 12*a* and a second pump port 12*b*. The first hydraulic pump 12 is switchable between a first discharge state and a second discharge state. The first hydraulic pump 12 draws in hydraulic fluid from the second pump port 12*b* and discharges hydraulic fluid from the first pump port 12*a* in the first discharge state. The first hydraulic pump 12 draws in hydraulic fluid from the first pump port 12*a* and discharges hydraulic fluid from the second pump port 12*b* in the second discharge state.

The second hydraulic pump 13 is a variable displacement hydraulic pump. The discharge flow rate of the second hydraulic pump 13 is controlled by controlling the tilt angle of the second hydraulic pump 13. The tilt angle of the second hydraulic pump 13 is controlled by a second pump-flow-rate control unit 26. The second pump-flow-rate control unit 26 controls the discharge flow rate of the second hydraulic pump 13 by controlling the tilt angle of the second hydraulic pump 13 on the basis of a command signal from the pump controller 24. The second hydraulic pump 13 is a two-directional discharge hydraulic pump. Specifically, the second hydraulic pump 13 has a first pump port 13*a* and a second pump port 13*b*. The second hydraulic pump 13 is able to be switched between a first discharge state and a second discharge state in the same way as the first hydraulic pump 12. The second hydraulic pump 13 draws in hydraulic fluid from the second pump port 13*b* and discharges hydraulic fluid from the first pump port 13*a* in the first discharge state. The second hydraulic pump 13 draws in hydraulic fluid from the first pump port 13*a* and discharges hydraulic fluid from the second pump port 13*b* in the second discharge state.

The hydraulic cylinder 14 is driven by hydraulic fluid discharged from the first hydraulic pump 12 and the second hydraulic pump 13. The hydraulic cylinder 14 drives working instrument such as a boom, an arm, or a bucket. The hydraulic cylinder 14 includes a cylinder rod 14*a* and a cylinder tube 14*b*. The inside of the cylinder tube 14*b* is partitioned by the cylinder rod 14*a* into a first chamber 14*c* and a second chamber 14*d*. The hydraulic cylinder 14 expands and contracts by switching between the supply and exhaust of hydraulic fluid to and from the first chamber 14*c* and the second chamber 14*d*. Specifically, the hydraulic cylinder 14 expands due to the supply of hydraulic fluid into the first chamber 14*c* and the exhaust of hydraulic fluid from the second chamber 14*d*. The hydraulic cylinder 14 contracts due to the supply of hydraulic fluid into the second chamber 14*d* and the exhaust of hydraulic fluid from the first chamber 14*c*. A pressure receiving area of the cylinder rod 14*a* in the first chamber 14*c* is greater than a pressure receiving area of the cylinder rod 14*a* in the second chamber 14*d*. Therefore, when the hydraulic cylinder 14 is expanded, more hydraulic fluid is supplied to the first chamber 14*c* than is exhausted from the second chamber 14*d*. When the hydraulic cylinder 14 is contracted, more hydraulic fluid is exhausted from the first chamber 14*c* than is supplied to the second chamber 14*d*.

The hydraulic fluid path 15 is connected to the first hydraulic pump 12, the second hydraulic pump 13, and the hydraulic cylinder 14. The hydraulic fluid path 15 has a first cylinder path 31, a second cylinder path 32, a first pump path 33, and a second pump path 34. The first cylinder path 31 is connected to the first chamber 14*c* of the hydraulic cylinder 14. The second cylinder path 32 is connected to the second chamber 14*d* of the hydraulic cylinder 14. The first pump path 33 is a path for supplying hydraulic fluid to the first chamber 14*c* of the hydraulic cylinder 14 via the first cylinder path 31, or for recovering hydraulic fluid from the first chamber 14*c* of the hydraulic cylinder 14 via the first cylinder path 31. The first pump path 33 is connected to the first pump port 12*a* of the first hydraulic pump 12. The first pump path 33 is connected to the first pump port 13*a* of the second hydraulic pump 13. Therefore, hydraulic fluid is supplied to the first pump path 33 from both the first hydraulic pump 12 and the second hydraulic pump 13. The second pump path 34 is a path for supplying hydraulic fluid to the second chamber 14*d* of the hydraulic cylinder 14 via the second cylinder path 32, or for recovering hydraulic fluid from the second chamber 14*d* of the hydraulic cylinder 14 via the second cylinder path 32. The second pump path 34 is connected to the second pump port 12*b* of the first hydraulic pump 12. The second pump port 13*b* of the second hydraulic pump 13 is connected to a hydraulic fluid tank 27. Therefore, hydraulic fluid is supplied to the second pump path 34 from the first hydraulic pump 12. The hydraulic fluid path 15 configures a closed circuit between the main pump 10 and the hydraulic cylinder 14 with the first pump path 33, the first cylinder path 31, the second cylinder path 32, and the second pump path 34. The main pump 10 is an example of a hydraulic pump in the present invention.

The hydraulic drive system 1 further includes a charge pump 28. The charge pump 28 is a hydraulic pump for replenishing hydraulic fluid to the first pump path 33 and the second pump path 34. The charge pump 28 is driven by the engine 11 to discharge hydraulic fluid. The charge pump 28 is a fixed displacement hydraulic pump. The hydraulic fluid path 15 further includes a charge path 35. The charge path 35 is connected to the first pump path 33 via a check valve 41*a*. The check valve 41*a* is open when the hydraulic pressure of the first pump path 33 is lower than the hydraulic pressure of the charge path 35. The charge path 35 is connected to the second pump path 34 via a check valve 41*b*. The check valve 41*b* is open when the hydraulic pressure of the second pump path 34 is lower than the hydraulic pressure of the charge path 35. The charge path 35 is connected to the hydraulic fluid tank 27 via a charge relief valve 42. The charge relief valve 42 maintains the hydraulic pressure in the charge path 35 at a prescribed charge pressure. When the hydraulic pressure of the first pump path 33 or the second pump path 34 becomes lower than the hydraulic pressure in the charge path 35, hydraulic fluid from the charge pump 28 is supplied to the first pump path 33 or the second pump path 34 via the charge path 35. As a result, the hydraulic pressure of the first pump path 33 or the second pump path 34 is maintained at a prescribed value or higher.

The hydraulic fluid path 15 further includes a relief path 36. The relief path 36 is connected to the first pump path 33 via a check valve 41*c*. The check valve 41*c* is open when the hydraulic pressure of the first pump path 33 is higher than the hydraulic pressure of the relief path 36. The relief path 36 is connected to the second pump path 34 via a check valve 41*d*. The check valve 41*d* is open when the hydraulic pressure of the second pump path 34 is higher than the hydraulic pressure of the relief path 36. The relief path 36 is connected to the charge path 35 via the relief valve 43. The relief valve 43 maintains the pressure of the relief path 36 at a pressure equal to or less than a prescribed relief pressure. As a result, the hydraulic pressure of the first pump path 33 and the second pump path 34 is maintained at a prescribed pressure equal to or less than the prescribed relief pressure.

The hydraulic fluid path 15 further includes an adjustment path 37. The adjustment path 37 is connected to the charge path 35. Excess hydraulic fluid from the first pump path 33 and the second pump path 34 is supplied to the adjustment path 37 when performing micro-speed control for the hydraulic cylinder 14. The micro-speed control of the hydraulic cylinder 14 is described in detail below.

The flow rate control valve 16 is an electromagnetic control valve controlled on the basis of command signals from the belowmentioned pump controller 24. The flow rate control valve 16 controls the flow rate of the hydraulic fluid supplied to the hydraulic cylinder 14 on the basis of command signals from the pump controller 24. The flow rate control valve 16 is disposed between the main pump 10 and the hydraulic cylinder 14 in the hydraulic fluid path 15. When the hydraulic cylinder 14 is expanded due to the belowmentioned micro-speed control of the hydraulic cylinder 14, the flow rate control valve 16 controls the flow rate of the hydraulic fluid supplied to the hydraulic cylinder 14 from the first pump path 33 and the flow rate of the hydraulic fluid supplied to the adjustment path 37 from the first pump path 33. When the hydraulic cylinder 14 is contracted due to the micro-speed control, the flow rate control valve 16 controls the flow rate of the hydraulic fluid supplied to the hydraulic cylinder 14 from the second pump path 34 and the flow rate of the hydraulic fluid supplied to the adjustment path 37 from the second pump path 34.

The flow rate control valve 16 includes a first pump port 16*a*, a first cylinder port 16*b*, a first adjustment port 16*c*, and a first bypass port 16*d*. The first pump port 16*a* is connected to the first pump path 33 via a first directional control unit 44. The first directional control unit 44 is a check valve for restricting the flow of the hydraulic fluid to one direction.

The first cylinder port 16*b* is connected to the first cylinder path 31. The first adjustment port 16*c* is connected to the adjustment path 37. The abovementioned first directional control unit 44 allows the flow of hydraulic fluid from the first pump path 33 to the first cylinder path 31 and prohibits the flow of hydraulic fluid from the first cylinder path 31 to the first pump path 33 when hydraulic fluid is supplied to the first cylinder path 31 from the first pump path 33 by the flow rate control valve 16.

The flow rate control valve 16 further includes a second pump port 16*e*, a second cylinder port 16*f*, a second adjustment port 16*g*, and a second bypass port 16*h*. The second pump port 16*e* is connected to the second pump path 34 via a second directional control unit 45. The second directional control unit 45 is a check valve for restricting the flow of hydraulic fluid to one direction. The second cylinder port 16*f* is connected to the second cylinder path 32. The second adjustment port 16*g* is connected to the adjustment path 37. The second directional control unit 45 allows the flow of hydraulic fluid from the second pump path 34 to the second cylinder path 32 and prohibits the flow of hydraulic fluid from the second cylinder path 32 to the second pump path 34 when hydraulic fluid is supplied to the second cylinder path 32 from the second pump path 34 by the flow rate control valve 16. The first directional control unit 44 and the second directional control unit 45 are examples of the directional control unit in the present invention.

The flow rate control valve 16 is switchable between a first position state P1, a second position state P2, and a neutral position state Pn. The flow rate control valve 16 allows communication between the first pump port 16*a* and the first cylinder port 16*b* and between the second cylinder port 16*f* and the second bypass port 16*h* in the first position state P1. Therefore, the flow rate control valve 16 connects the first pump path 33 to the first cylinder path 34 via the first directional control unit 44 and connects the second cylinder path 32 to the second pump path 34 while bypassing the second directional control unit 45 in the first position state P1. The first bypass port 16*d*, the first adjustment port 16*c*, the second pump port 16*e*, and the second adjustment port 16*g* are all shut off when the flow rate control valve 16 is in the first position state P1.

When the hydraulic cylinder 14 is expanded, the first hydraulic pump 12 and the second hydraulic pump 13 are driven in the first discharge state and the flow rate control valve 16 is set to the first position state P1. As a result, hydraulic fluid discharged from the first pump port 12*a* of the first hydraulic pump 12 and from the first pump port 13*a* of the second hydraulic pump 13 passes through the first pump path 33, the first directional control unit 44, and the first cylinder path 31 and is supplied to the first chamber 14*c* of the hydraulic cylinder 14. The hydraulic fluid in the second chamber 14*d* of the hydraulic cylinder 14 passes through the second cylinder path 32 and the second pump path 34 and is recovered in the second pump port 12*b* of the first hydraulic pump 12. As a result, the hydraulic cylinder 14 expands.

The flow rate control valve 16 allows communication between the second pump port 16*e* and the second cylinder port 16*f* and between the first cylinder port 16*b* and the first bypass port 16*d* in the second position state P2. Therefore, the flow rate control valve 16 connects the first cylinder path 31 to the first pump path 34 while bypassing the first directional control unit 44 and connects the second pump path 34 to the second cylinder path 32 via the second directional control unit 45 in the second position state P2. The first pump port 16*a*, the first adjustment port 16*c*, the second bypass port 16*h*, and the second adjustment port 16*g* are all shut off when the flow rate control valve 16 is in the second position state P2.

When the hydraulic cylinder 14 is contracted, the first hydraulic pump 12 and the second hydraulic pump 13 are driven in a second discharge state and the flow rate control valve 16 is set to the second position state P2. As a result, hydraulic fluid discharged from the second pump port 12*b* of the first hydraulic pump 12 passes through the second pump path 34, the second directional control unit 45, and the second cylinder path 32 and is supplied to the second chamber 14*d* of the hydraulic cylinder 14. The hydraulic fluid in the first chamber 14*c* of the hydraulic cylinder 14 passes through the first cylinder path 31*a* and the first pump path 33 to be recovered in the first pump port 12*a* of the first hydraulic pump 12 and in the first pump port 13*a* of the second hydraulic pump 13. As a result, the hydraulic cylinder 14 contracts.

The flow rate control valve 16 allows communication between the first bypass port 16*d* and the first adjustment port 16*c*, and between the second bypass port 16*h* and the second adjustment port 16*g* in the neutral position state Pn. Therefore, the flow rate control valve 16 connects the first pump path 33 to the adjustment path 37 while bypassing the first directional control unit 44, and connects the second pump path 34 to the adjustment path 37 while bypassing the second directional control unit 45 in the neutral position state Pn. When the flow rate control valve 16 is in the neutral position state Pn, the first pump port 16*a*, the first cylinder port 16*b*, the second pump port 16*e*, and the second cylinder port 16*f* are all shut off.

The flow rate control valve 16 may be set to any position state between the first position state P1 and the neutral position state Pn. As a result, the flow rate control valve 16 is able to control the flow rate of the hydraulic fluid supplied to the first cylinder path 31 from the first pump path 33 via the first directional control unit 44, and the flow rate of the hydraulic fluid supplied to the adjustment path 37 from the first pump path 33. Specifically, the flow rate control valve 16 is able to control the flow rate of the hydraulic fluid supplied from the first hydraulic pump 12 and the second hydraulic pump 13 to the first chamber 14*c* of the hydraulic cylinder 14, and the flow rate of the hydraulic fluid supplied from the first hydraulic pump 12 and the second hydraulic pump 13 to the adjustment path 37.

The flow rate control valve 16 may be set to any position state between the second position state P2 and the neutral position state Pn. As a result, the flow rate control valve 16 is able to control the flow rate of the hydraulic fluid supplied from the second pump path 34 to the second cylinder path 32 via the second directional control unit 45 and the flow rate of the hydraulic fluid supplied from the second pump path 34 to the adjustment path 37. Specifically, the flow rate control valve 16 is able to control the flow rate of the hydraulic fluid from the first hydraulic pump 12 to the second chamber 14*d* of the hydraulic cylinder 14 and the flow rate of the hydraulic fluid from the first hydraulic pump 12 to the adjustment path 37.

The hydraulic drive system 1 further includes an operating device 46. The operating device 46 includes an operating member 46*a* and an operation detecting unit 46*b*. The operating member 46*a* is operated by an operator in order to command various types of actions of the work machine. For example, when the hydraulic cylinder 14 is a boom cylinder for driving a boom, the operating member 46*a* is a boom operating lever for operating the boom. The operating member 46*a* can be operated in two directions: a direction for expanding the hydraulic cylinder 14 from the neutral position, and a direction for contracting the hydraulic cylinder 14 from the neutral position. The operation detecting unit 46*b* detects the operation amount and the operation direction of the operating member 46*a*. The operation detecting unit 46*b* is a sensor, for example, for detecting a position of the operating member 46*a*. When the operating member 46 is positioned in the neutral position, the operation amount of the operating member 46*a* is zero. Detection signals that indicate the operation amount and the operation direction of the operating member 46*a* are input from the operation detecting unit 46*b* to the pump controller 24. The pump controller 24 calculates a target flow rate of the hydraulic fluid supplied to the hydraulic cylinder 14 in response to the operation amount of the operating member 46*a*. Therefore, the operating member 46*a* is an example of the target flow rate setting unit for setting a target flow rate of the hydraulic fluid supplied to the hydraulic cylinder 14. The pump controller 24 is an example of the control device in the present invention.

The engine controller 22 controls the output of the engine 11 by controlling the fuel injection device 21. Engine output torque characteristics determined on the basis of a set target engine rotation speed and a work mode are mapped and stored in the engine controller 22. The engine output torque characteristics indicate the relationship between the output torque and the rotation speed of the engine 11. The engine controller 22 controls the output of the engine 11 on the basis of the engine output torque characteristics.

When the target flow rate is within the prescribed range set by the operating member 46*a*, the pump controller 24 uses the flow rate control valve 16 to control the flow rate of the hydraulic fluid supplied to the hydraulic cylinder 14. When the target flow rate is greater than the prescribed range set by the operating member 46*a*, the pump controller 24 uses the first pump-flow-rate control unit 25 and the second pump-flow-rate control unit 26 to control the flow rate of the hydraulic fluid being supplied to the hydraulic cylinder 14. Specifically, when the target flow rate is within the prescribed range set by the operating member 46*a*, the pump controller 24 uses the flow rate control valve 16 to control the flow rate of the hydraulic fluid being supplied to the hydraulic cylinder 14. When the hydraulic cylinder 14 is expanded, the pump controller 24 uses the first pump-flow-rate control unit 25 and the second pump-flow-rate control unit 26 to control the flow rate of the hydraulic fluid being supplied to the hydraulic cylinder 14 when the operation amount of the operating member 46*a* is greater than the prescribed operation range. When the hydraulic cylinder 14 is contracted, the pump controller 24 uses the first pump-flow-rate control unit 25 to control the flow rate of the hydraulic fluid being supplied to the hydraulic cylinder 14 when the operation amount of the operating member 46*a* is greater than the prescribed operation range. The prescribed operation range is an operation range of the operating member 46*a* corresponding to the prescribed range of the abovementioned target flow rate. Specifically, the "prescribed operation range" is an operation range of the operating member 46*a* when the hydraulic cylinder 14 is controlled at micro-speeds. Specifically, the "prescribed operation range" is an operation range of the operating member 46*a* required for controlling the micro-speed so as to fall below the minimum controllable flow rate of the discharge flow rate of the hydraulic pump. For example, the prescribed operation range is a range of about 15 to 20% of the maximum operation amount in the expansion direction of the hydraulic cylinder 14 from the neutral position. The prescribed operation range is a range of about 15 to 20% of the maximum operation amount in the contraction direction of the hydraulic cylinder 14 from the neutral position. Hereinbelow, the control of the hydraulic cylinder 14 when the operation amount of the operating member 46*a* is within the prescribed operation range is referred to as "micro-speed control." The control of the hydraulic cylinder 14 when the operation amount of the operating member 46*a* is greater than the prescribed operation range is referred to as "normal control." The following explanation discusses the control when expanding the hydraulic cylinder 14.

Figure 2:
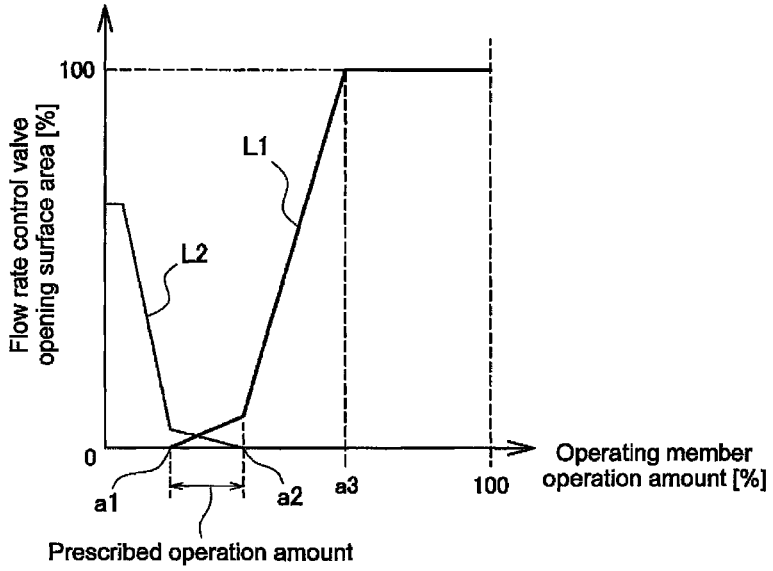
FIG. 2 is a graph illustrating control of a flow rate control valve in the hydraulic drive system according to the first embodiment.

The pump controller 24 controls the flow rate of the hydraulic fluid to the hydraulic cylinder 14 by controlling the flow rate control valve 16 during the micro-speed control of the hydraulic cylinder 14. FIG. 2 is a graph illustrating changes in the opening surface area of the flow rate control valve 16 with respect to the operation amount of the operating member 46*a*. The horizontal axis in FIG. 2 represents a percentage of the operation amount where the maximum operation amount of the operating member 46*a* is 100. The vertical axis represents the percentage of the opening surface area where the maximum opening surface area of the flow rate control valve 16 is 100, and corresponds to the opening degree of the flow rate control valve 16. The line L1 in FIG. 2 represents the opening surface area between the first pump port 16*a* and the first cylinder port 16*b* in the flow rate control valve 16. Specifically, the line L1 represents the opening surface area between the first pump path 33 and the first cylinder path 31. The line L2 represents the opening surface area between the first bypass port 16*d* and the first adjustment port 16*c* in the flow rate control valve 16. Specifically, the line L2 represents the opening surface area between the first pump path 33 and the adjustment path 37. As illustrated in FIG. 2, the abovementioned prescribed operation range is a range between a first operation amount a1 and a second operation amount a2.

When the operation amount of the operating member 46*a* is smaller than the prescribed operation range, the pump controller 24 sets the flow rate control valve 16 to the neutral position state Pn. As a result, the opening surface area between the first pump path 33 and the first cylinder path 31 is zero when the operation amount of the operating member 46*a* is smaller than the prescribed operation range as illustrated by the line L1. The flow rate control valve 16 is controlled so that as the operation amount of the operating member 46*a* increases, the opening surface area between the first pump path 33 and the adjustment path 37 becomes correspondingly smaller as illustrated by the line L2. When the operation amount of the operating member 46*a* is zero, the pump controller 24 sets the tilt angle of the first hydraulic pump 12 and the tilt angle of the second hydraulic pump 13 to be zero.

When the operation amount of the operating member 46*a* is within the prescribed operation range, the pump controller 24 controls the flow rate control valve 16 between the first position state P1 and the neutral position state Pn. Specifically, the flow rate control valve 16 is controlled so that as the operation amount of the operating member 46*a* increases from the first operation amount a1, the opening surface area between the first pump path 33 and the first cylinder path 31 correspondingly increases when the operation amount of the operating member 46*a* is within the prescribed operation range as illustrated by the line L1. The flow rate control valve 16 is controlled so that as the operation amount of the operating member 46*a* increases from the first operation amount a1, the opening surface area between the first pump path 33 and the adjustment path 37 becomes correspondingly smaller as illustrated by the line L2. The flow rate control valve 16 is controlled so that the opening surface area between the first pump path 33 and the adjustment path 37 becomes zero when the operation amount of the operating member 46*a* is the second operation amount a2. Moreover, a total discharge flow rate of the first hydraulic pump 12 and the second hydraulic pump 13 is maintained at a prescribed discharge flow rate when the operation amount of the operating member 46*a* is within the prescribed operation range. Specifically, a prescribed tilt angle of the first hydraulic pump 12 and the second hydraulic pump 13 is maintained so that the total discharge flow rate of the first hydraulic pump 12 and the second hydraulic pump 13 is maintained at the prescribed discharge flow rate. The prescribed discharge flow rate is larger than the target flow rate that corresponds to the operation amount of the operating member 46*a*. Therefore, hydraulic fluid from the first hydraulic pump 12 and the second hydraulic pump 13 is supplied by being divided between the hydraulic cylinder 14 and the adjustment path 37. Specifically, within the hydraulic fluid from the first hydraulic pump 12 and the second hydraulic pump 13, the hydraulic fluid of the flow rate required for the micro-speed control of the hydraulic cylinder 14 is supplied to the hydraulic cylinder 14 via the first cylinder path 31. Excess hydraulic fluid is fed to the charge path 35 via the adjustment path 37. The excess hydraulic fluid is returned to the first pump path 33 or the second pump path 34 from the charge path 35 or fed to the hydraulic fluid tank 27 via the charge relief valve 42.

The pump controller 24 controls the flow rate of the hydraulic fluid to the hydraulic cylinder 14 by controlling the first pump-flow-rate control unit 25 and the second pump-flow-rate control unit 26 during normal control of the hydraulic cylinder 14. Specifically, when the operation amount of the operating member 46*a* is larger than the prescribed operation range, the pump controller 24 sets the flow rate control valve 16 to the first position state P1. Therefore, the opening surface area between the first pump path 33 and the adjustment path 37 becomes zero as illustrated by the line L2 in FIG. 2. Specifically, communication between the first pump path 33 and the adjustment path 37 is closed. When the operation amount of the operating member 46*a* is larger than the prescribed operation range, the pump controller 24 fully opens the opening surface area between the first pump path 33 and the first cylinder path 31. Specifically, when the operation amount of the operating member 46*a* reaches the second operation amount a2, the pump controller 24 sends a command signal to the flow rate control valve 16 to fully open the opening surface area between the first pump path 33 and the first cylinder path 31. However, due to the construction of the flow rate control valve 16, it is impossible to make the opening surface area between the first pump path 33 and the first cylinder path 31 fully open at the moment when the operation amount of the operating member 46*a* reaches the second operation amount a2. As a result, the opening surface area between the first pump path 33 and the first cylinder path 31 increases toward being fully open in a region where the operation amount of the operating member 46*a* is between the second operation amount a2 and a third operation amount a3. When the operation amount of the operating member 46*a* reaches the third operation amount a3 that is larger than the second operation amount a2, the opening surface area between the first pump path 33 and the first cylinder path 31 reaches the position of fully open in the construction of the flow rate control valve 16. When the operation amount of the operating member 46*a* is equal to or greater than the third operation amount a3, the opening surface area between the first pump path 33 and the first cylinder path 31 is maintained at fully open. When the operation amount of the operating member 46*a* is greater than the prescribed operation range, the first pump-flow-rate control unit 25 and the second pump-flow-rate control unit 26 are controlled so that the total discharge flow rate of the first hydraulic pump 12 and the second hydraulic pump 13 becomes the target flow rate corresponding to the operation amount of the operating member 46*a*. As a result, the full amount of the hydraulic fluid fed from the first pump path 33 to the flow rate control valve 16 is supplied to the hydraulic cylinder 14. When the hydraulic cylinder 14 is in the normal control, the pump controller 24 controls the discharge flow rate of the first hydraulic pump 12 and the discharge flow rate of the second hydraulic pump 13 so that an absorption torque of the first hydraulic pump 12 and an absorption torque of the second hydraulic pump 13 are controlled on the basis of the pump absorption torque characteristics. The pump absorption torque characteristics indicate the relationship between the pump absorption torque and the engine rotation speed. The pump absorption torque characteristics are previously set on the basis of a working mode and driving conditions and are stored in the pump controller 24.

While controlling by the pump controller 24 when the hydraulic cylinder 14 is expanded has been described herein, controlling by the pump controller 24 when the hydraulic cylinder 14 is contracted is the same as described above. However, when the hydraulic cylinder 14 is contracted, hydraulic fluid from the first hydraulic pump 12 is supplied to the hydraulic cylinder 14 without supplying the hydraulic fluid from the second hydraulic pump 13. Therefore, during normal control when the hydraulic cylinder 14 is contracting, the hydraulic fluid discharged from the first hydraulic pump 12 is supplied to the hydraulic cylinder 14 via the second pump path 34 and the second cylinder path 32. The pump controller 24 controls the discharge flow rate of the first hydraulic pump 12 by controlling the first pump-flow-rate control unit 25. During micro-speed control when the hydraulic cylinder 14 is contracting, a portion of the hydraulic fluid discharged from the first hydraulic pump 12 is supplied to the hydraulic cylinder 14 via the second pump path 34 and the second cylinder path 32. Excess hydraulic fluid among the hydraulic fluid discharged from the first hydraulic pump 12 is fed to the charge path 35 via the adjustment path 37. The pump controller 24 controls the flow rate of the hydraulic fluid supplied from the first hydraulic pump 12 to the hydraulic cylinder 14 and the flow rate of the hydraulic fluid supplied from the first hydraulic pump 12 to the adjustment path 37 by controlling the flow rate control valve 16.

The hydraulic drive system 1 according to the present embodiment has the following characteristics.

The flow rate of the hydraulic fluid supplied to the hydraulic cylinder 14 is controlled by the flow rate control valve 16 during the micro-speed control of the hydraulic cylinder 14. As a result, the flow rate of the hydraulic fluid supplied to the hydraulic cylinder 14 is able to be controlled as a very small flow rate even if the minimum controllable flow rate of the discharge flow rate from the hydraulic pump (in the following explanation, "hydraulic pump" refers to the first hydraulic pump 12 and the second hydraulic pump 13 when expanding the hydraulic cylinder 14, and refers to the first hydraulic pump 12 when contracting the hydraulic cylinder 14) is not small enough to allow control the target flow rate as a very small flow rate. Consequently, micro-speed control of the hydraulic cylinder is possible.

The flow rate of the hydraulic fluid supplied to the hydraulic cylinder 14 is controlled by controlling the discharge flow rate of the hydraulic pump during normal control of the hydraulic cylinder 14. While energy loss of the flow rate control valve 16 increases when hydraulic fluid having a large flow rate is controlled by the flow rate control valve 16, the occurrence of such an energy loss can be suppressed in the hydraulic drive system 1 according to the present embodiment.

Moreover, the first directional control unit 44 or the second directional control unit 45 allows the flow of the hydraulic fluid from the hydraulic pump to the hydraulic cylinder 14 and prohibits the flow of the hydraulic fluid from the hydraulic cylinder 14 to the hydraulic pump when the hydraulic fluid is supplied from the hydraulic pump to the hydraulic cylinder 14 via the flow rate control valve 16. As a result, the stroke amount of the hydraulic cylinder 14 can be held in a very small operation. For example, when hoisting the boom in a very small speed, a drop in the boom due to a reverse flow of the hydraulic fluid from the hydraulic cylinder 14 can be prevented.

The opening degree of the path in the flow rate control valve 16 is fully open during normal control of the hydraulic cylinder 14. As a result, pressure loss of the hydraulic fluid in the flow rate control valve 16 can be suppressed and energy loss can be suppressed.

The first pump path 33, the first cylinder path 31, and the adjustment path 37 are connected to the flow rate control valve 16. The second pump path 34 and the second cylinder path 32 are also connected to the flow rate control valve 16. Therefore, the flow rate of the hydraulic fluid supplied from the hydraulic pump to the hydraulic cylinder 14 and the flow rate of the hydraulic fluid supplied from the hydraulic pump to the adjustment path 37 are both controlled by the flow rate control valve 16. As a result, the control of the flow rate of the hydraulic fluid supplied from the hydraulic pump to the hydraulic cylinder 14 and the control of the flow rate of the hydraulic fluid supplied from the hydraulic pump to the adjustment path 37 can be easily coordinated by the flow rate control valve 16.

The discharge flow rate of the hydraulic pump is controlled as a flow rate equal to or greater than the target flow rate by controlling the tilt angle of the hydraulic pump during the micro-speed control of the hydraulic cylinder 14. As a result, the flow rate of the hydraulic fluid supplied to the hydraulic cylinder 14 can be adjusted by the flow rate control valve 16 and the flow rate of the hydraulic fluid to the hydraulic cylinder 14 can be controlled with more accuracy. Moreover, while hydraulic fluid having a flow rate greater than the flow rate necessary for the hydraulic cylinder 14 is discharged from the hydraulic pump, energy loss is small since the flow rate discharged from the hydraulic pump is originally small during the micro-speed control.

2. Second Embodiment

Figure 3:
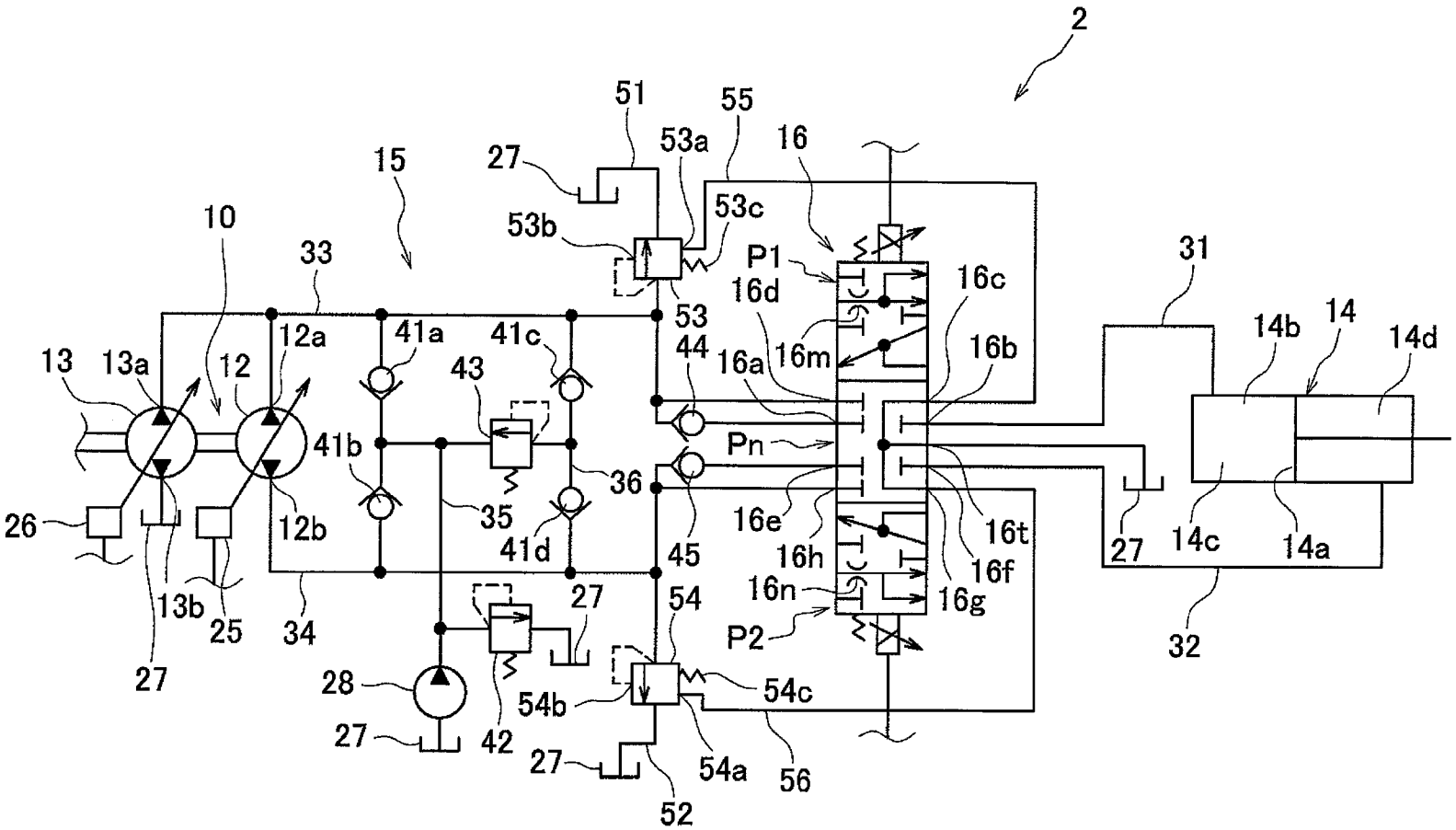
FIG. 3 is a block diagram of a configuration of a hydraulic drive system according to a second embodiment of the present invention.

Next, a hydraulic drive system 2 according to the second embodiment of the present invention will be described. FIG. 3 is a block diagram of a configuration of a hydraulic drive system 2 according to the second embodiment. Configurations in FIG. 3 that are the same as the first embodiment are given the same reference numbers as in the first embodiment.

The hydraulic fluid path 15 in the hydraulic drive system 2 includes a first adjustment path 51 and a second adjustment path 52 in place of the adjustment path 37 in the first embodiment. The first adjustment path 51 and the second adjustment path 52 are each connected to the hydraulic fluid tank 27. The hydraulic drive system 2 further includes a first unloading valve 53 and a second unloading valve 54. The first adjustment path 51 is connected to the first pump path 33 via the first unloading valve 53. The second adjustment path 52 is connected to the second pump path 34 via the second unloading valve 54. The hydraulic fluid path 15 further includes a first pilot path 55 and a second pilot path 56. The first pilot path 55 is connected to the first adjustment port 16*c* in the flow rate control valve 16. The second pilot path 56 is connected to the second adjustment port 16*g* in the flow rate control valve 16.

The first unloading valve 53 includes a first pilot port 53*a* and a second pilot port 53*b*. The first pilot port 53*a* is connected to the first pilot path 55. The second pilot port 53*b* is connected to the first pump path 33. The first unloading valve 53 is an example of an adjustment flow rate control unit in the present invention. The first unloading valve 53 controls the flow rate of hydraulic fluid supplied to the first adjustment path 51 from the first pump path 33 in response to a differential hydraulic pressure between a hydraulic pressure input into the first pilot port 53*a* and a hydraulic pressure input into the second pilot port 53*b*. Specifically, the first unloading valve 53 controls the flow rate of the hydraulic fluid supplied to the first adjustment path 51 from the first pump path 33 in response to the differential hydraulic pressure between the first pump path 33 and the first pilot path 55. Specifically, the first unloading valve 53 allows communication between the first pump path 33 and the first adjustment path 51 when the differential hydraulic pressure between the first pump path 33 and the first pilot path 55 is greater than a prescribed set pressure. An opening surface area between the first pump path 33 and the first adjustment path 51 in the first unloading valve 53 becomes smaller in correspondence to the differential hydraulic pressure between the first pump path 33 and the first pilot path 55 becoming smaller. The first unloading valve 53 shuts off communication between the first pump path 33 and the first adjustment path 51 when the differential hydraulic pressure between the first pump path 33 and the first pilot path 55 is equal to or less than the prescribed set pressure. The first unloading valve 53 includes an elastic member 53*c* such as a spring, for example, and the above prescribed set pressure is regulated by a biasing force from the elastic member 53*c*.

The second unloading valve 54 includes a first pilot port 54*a* and a second pilot port 54*b*. The first pilot port 54*a* is connected to the second pilot path 56. The second pilot port 54*b* is connected to the second pump path 34. The second unloading valve 54 controls the flow rate of hydraulic fluid supplied to the second adjustment path 52 from the second pump path 34 in response to a differential hydraulic pressure between a hydraulic pressure input into the first pilot port 54*a* and a hydraulic pressure input into the second pilot port 54*b*. Specifically, the second unloading valve 54 controls the flow rate of the hydraulic fluid supplied to the second adjustment path 52 from the second pump path 34 in response to the differential hydraulic pressure between the second pump path 34 and the second pilot path 56. The second unloading valve 54 allows communication between the second pump path 34 and the second adjustment path 52 when the differential hydraulic pressure between the second pump path 34 and the second pilot path 56 is greater than a prescribed set pressure. An opening surface area between the second pump path 34 and the second adjustment path 52 in the second unloading valve 54 becomes smaller in correspondence to the differential hydraulic pressure between the second pump path 34 and the second pilot path 56 becoming smaller. The second unloading valve 54 shuts off communication between the second pump path 34 and the second adjustment path 52 when the differential hydraulic pressure between the second pump path 34 and the second pilot path 56 is equal to or less than the prescribed set pressure. The second unloading valve 54 includes an elastic member 54*c* such as a spring, for example, and the above prescribed set pressure is regulated by a biasing force from the elastic member 54*c*.

The flow rate control valve 16 further includes a tank port 16*t*. The tank port 16*t* is connected to the hydraulic fluid tank 27. The flow rate control valve 16 is able to be switched between a first position state P1, a second position state P2, and a neutral position state Pn in accordance with a command signal from the pump controller 24.

In the first position state P1, the flow rate control valve 16 allows the first pump port 16*a* to communicate with the first cylinder port 16*b* and the first adjustment port 16*c* via a restriction 16*m*, and allows the second cylinder port 16*f* and the second adjustment port 16*g* to communicate with the second bypass port 16*h*. Therefore, the flow rate control valve 16 connects the first pump path 33 to the first cylinder path 31 via the first directional control unit 44 and the restriction 16*m*, and connects the first cylinder path 31 to the first pilot path 55 in the first position state P1. The flow rate control valve 16 connects the second cylinder path 32 and the second pilot path 56 to the second pump path 34 while bypassing the second directional control unit 45. The first bypass port 16*d*, tank port 16*t*, and the second pump port 16*e* are all shut off when the flow rate control valve 16 is in the first position state P1.

In the second position state P2, the flow rate control valve 16 allows the second pump port 16*e* to communicate with the second cylinder port 16*f* and the second adjustment port 16*g* via a restriction 16*n*, and allows the first cylinder port 16*b* and the first bypass port 16*c* to communicate with the first bypass port 16*d*. Therefore, the flow rate control valve 16 connects the second pump path 34 to the second cylinder path 32 via the second directional control unit 45 and the restriction 16*n*, and connects the second cylinder path 32 and the second pilot path 56 in the second position state P2. The flow rate control valve 16 connects the first cylinder path 31 and the first pilot path 55 to the first pump path 33 while bypassing the first directional control unit 44. The second bypass port 16*h*, the tank port 16*t*, and the first pump port 16*a* are all shut off when the flow rate control valve 16 is in the second position state P2.

The flow rate control valve 16 allows communication between the first adjustment port 16*c*, the second adjustment port 16*g*, and the tank port 16*t* in the neutral position state Pn. Therefore, the flow rate control valve 16 connects the first pilot path 55 and the second pilot path 56 to the hydraulic fluid tank 27 in the neutral position state Pn. When the flow rate control valve 16 is in the neutral position state Pn, the first pump port 16*a*, the first cylinder port 16*b*, the first bypass port 16*d*, the second pump port 16*e*, the second cylinder port 16*f*, and the second bypass port 16*h* are all shut off.

The flow rate control valve 16 may be set to any position state between the first position state P1 and the neutral position state Pn. As a result, the flow rate control valve 16 is able to control the flow rate of the hydraulic fluid supplied to the first cylinder path 31 from the first pump path 33 via the first directional control unit 44. Specifically, the flow rate control valve 16 is able to control the flow rate of the hydraulic fluid supplied from the first hydraulic pump 12 and the second hydraulic pump 13 to the first chamber 14*c* of the hydraulic cylinder 14.

The flow rate control valve 16 may be set to any position state between the second position state P2 and the neutral position state Pn. As a result, the flow rate control valve 16 is able to control the flow rate of the hydraulic fluid supplied from the second pump path 34 to the second cylinder path 32 via the second directional control unit 45. Specifically, the flow rate control valve 16 is able to control the flow rate of the hydraulic fluid supplied from the first hydraulic pump 12 to the second chamber 14*d* of the hydraulic cylinder 14.

Figure 4:
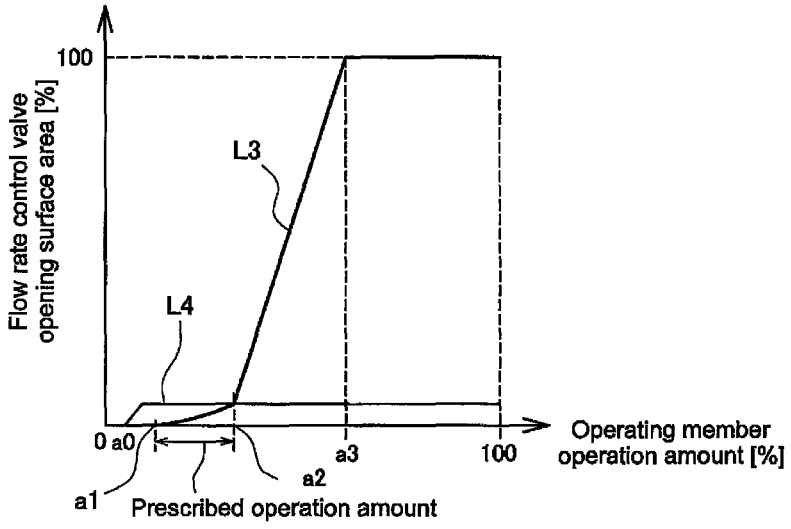
FIG. 4 is a graph illustrating control of a flow rate control valve in the hydraulic drive system according to the second embodiment.

FIG. 4 is a graph illustrating changes in the opening surface area of the flow rate control valve 16 with respect to the operation amount of the operating member 46*a* when the hydraulic cylinder 14 is expanded. The line L3 in FIG. 4 represents the opening surface area between the first pump port 16*a* and the first cylinder port 16*b* in the flow rate control valve 16. Specifically, the line L3 represents the opening surface area between the first pump path 33 and the first cylinder path 31. The line L4 in FIG. 4 represents the opening surface area between the first cylinder port 16*b* and the first adjustment port 16*c*. Specifically, the line L4 represents the opening surface area between the first cylinder path 34 and the first pilot path 55.

When the operation amount of the operating member 46*a* is equal to or above an operation amount a0 which is below the prescribed operation range, the pump controller 24 controls the flow rate control valve 16 between the first position state P1 and the neutral position state Pn. As a result, the opening surface area between the first cylinder path 31 and the first pilot path 55 is maintained at a prescribed surface area as illustrated by the line L4. As a result, the hydraulic pressure of the first cylinder path 31 is input into the first pilot port 53*a* in the first unloading valve 53. Therefore, the hydraulic pressure of the first cylinder path 31 is input into the first pilot port 53*a* in the first unloading valve 53 when the operation amount of the operating member 46*a* is equal to or greater than the operation amount a0.

The flow rate control valve 16 is controlled so that as the operation amount of the operating member 46*a* increases, the opening surface area between the first pump path 33 and the first cylinder path 31 correspondingly increases when the operation amount of the operating member 46*a* is within the prescribed operation range as illustrated by the line L3. The pump controller 24 at this time controls the flow rate control valve 16 so that the flow rate of the hydraulic fluid supplied to the hydraulic cylinder 14 meets the target flow rate corresponding to the operation amount of the operating member 46*a*. The differential hydraulic pressure between the first pump path 33 and the first cylinder path 31 is greater than a prescribed set pressure since the opening surface area between the first cylinder path 31 and the first pump path 33 is small when the operation amount of the operating member 46*a* is within the prescribed operation range as illustrated by line L3. As a result, the first unloading valve 53 allows communication between the first pump path 33 and the first adjustment path 51. The hydraulic fluid discharged from the first hydraulic pump 12 and the second hydraulic pump 13 is thus supplied by being divided between the first cylinder path 31 and the first adjustment path 51. Therefore, a portion of the hydraulic fluid discharged from the first hydraulic pump 12 and the second hydraulic pump 13 is supplied to the hydraulic cylinder 14, and the excess hydraulic fluid is fed into the charge path 35 via the first adjustment path 51.

As the operation amount of the operating member 46*a* increases, the opening surface area between the first cylinder path 31 and the first pump path 33 increases as illustrated by the line L3. The differential hydraulic pressure between the first pump path 33 and the first cylinder path 31 becomes equal to or less than the prescribed set pressure when the operation amount of the operating member 46*a* becomes greater than the prescribed operation range. As a result, the first unloading valve 53 shuts off communication between the first pump path 33 and the first adjustment path 51. As a result, the hydraulic fluid discharged from the first hydraulic pump 12 and the second hydraulic pump 13 is supplied to the first cylinder path 31 without being supplied to the first adjustment path 51. As a result, the full amount of the hydraulic fluid fed from the first pump path 33 to the flow rate control valve 16 is supplied to the hydraulic cylinder 14. When the operation amount of the operating member 46*a* is greater than the prescribed operation range, the first pump-flow-rate control unit 25 and the second pump-flow-rate control unit 26 are controlled so that the total discharge flow rate of the first hydraulic pump 12 and the second hydraulic pump 13 becomes the target flow rate corresponding to the operation amount of the operating member 46*a*.

Other controls and configurations of the hydraulic drive system 2 are the same as those of the hydraulic drive system 1 in the first embodiment and thus explanations thereof are omitted.

The hydraulic drive system 2 according to the present embodiment has the same characteristics as the hydraulic drive system 1 of the first embodiment. The hydraulic drive system 2 according to the present embodiment further includes the following characteristics.

The differential hydraulic pressure between the first pump path 33 and the first cylinder path 31 is greater than the prescribed set pressure when the operation amount of the operating member 46*a* is within the prescribed operation range. Therefore, the first unloading valve 53 allows communication between the first pump path 33 and the first adjustment path 51 when the operation amount of the operating member 46*a* is within the prescribed operation range. As a result, excess hydraulic fluid is fed to the first adjustment path 51.

The opening surface area between the first pump path 33 and the first adjustment path 51 increases in correspondence to an increase in the differential hydraulic pressure between the first pump path 33 and the first cylinder path 31 when the operation amount of the operating member 46*a* is within the prescribed operation range. Therefore, the flow rate of the hydraulic fluid fed to the first adjustment path 51 can be adjusted in response to the differential hydraulic pressure between the first pump path 33 and the first cylinder path 31.

Moreover, the differential hydraulic pressure between the first pump path 33 and the first cylinder path 31 is equal to or less than the prescribed set pressure when the operation amount of the operating member 46*a* is greater than the prescribed operation range. Therefore, the first unloading valve 53 shuts off communication between the first pump path 33 and the first adjustment path 51 when the operation amount of the operating member 46*a* is greater than the prescribed operation range. As a result, the occurrence of energy loss can be suppressed by feeding a portion of the hydraulic fluid to the adjustment path 51 when the flow rate of the hydraulic fluid is large.

While characteristics and controlling by the pump controller 24 when the hydraulic cylinder 14 is expanded has been described herein, the characteristics and controlling by the pump controller 24 when the hydraulic cylinder 14 is contracted is the same as described above.

3. Third Embodiment

Figure 5:
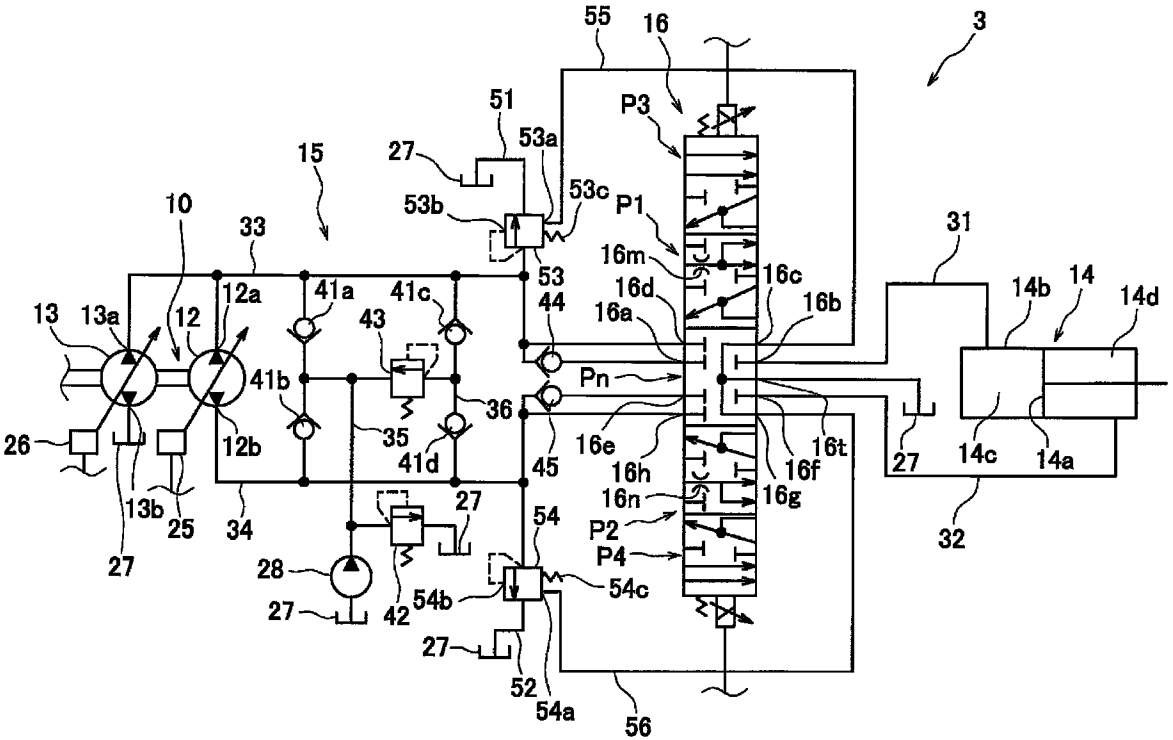
FIG. 5 is a block diagram of a configuration of a hydraulic drive system according to a third embodiment of the present invention.

Next, a hydraulic drive system 3 according to the third embodiment of the present invention will be described. FIG. 5 is a block diagram of a configuration of a hydraulic drive system 3 according to the third embodiment. Configurations in FIG. 5 that are the same as the first embodiment are given the same reference numbers as in the first embodiment. Configurations in FIG. 5 that are the same as the second embodiment are given the same reference numbers as in the second embodiment.

As illustrated in FIG. 5, the flow rate control valve 16 is switchable between a third position state P3 and a fourth position state P4 in addition to the first position state P1, the second position state P2, and the neutral position state Pn of the second embodiment.

The flow rate control valve 16 allows communication between the first pump port 16*a* and the first cylinder port 16*b* and between the first bypass port 16*d* and the first adjustment port 16*c* in the third position state P3. The flow rate control valve 16 allows communication between the second cylinder port 16*f*, the second adjustment port 16*g*, and the second bypass port 16*h* in the third position state P3. Therefore, the flow rate control valve 16 allows the first pump path 33 to communicate with the first cylinder path 31 via the first directional control unit 44 and allows the first pump path 33 to communicate with the first pilot path 55 while bypassing the first directional control unit 44 in the third position state P3. The flow rate control valve 16 also allows the second cylinder path 32 and the second pilot path 56 to communicate with the second pump path 34 while bypassing the second directional control unit 45.

The flow rate control valve 16 allows communication between the second pump port 16*e* and the second cylinder port 16*f* and between the second bypass port 16*h* and the second adjustment port 16*g* in the fourth position state P4. The flow rate control valve 16 also allows the first cylinder port 16*b*, the first adjustment port 16*c* to communicate with the first bypass port 16*d* in the fourth position state P4. Therefore, the flow rate control valve 16 allows the second pump path 34 to communicate with the second cylinder path 32 via the second directional control unit 45 and connects the second pump path 34 to the second pilot path 56 while bypassing the second directional control unit 45 in the fourth position state P4. The flow rate control valve 16 also allows the first cylinder path 31 and the first pilot path 55 to communicate with the first pump path 33 while bypassing the first directional control unit 44 in the fourth position state P4.

Figure 6:
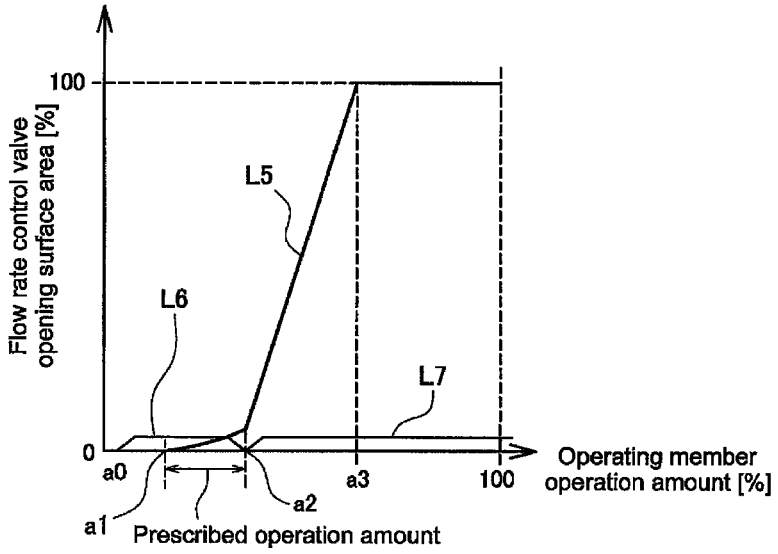
FIG. 6 is a graph illustrating control of a flow rate control valve in the hydraulic drive system according to the third embodiment.

FIG. 6 is a graph illustrating changes in the opening surface area of the flow rate control valve 16 with respect to the operation amount of the operating member 46*a* when the hydraulic cylinder 14 is expanded. The line L5 in FIG. 6 represents the opening surface area between the first pump port 16*a* and the first cylinder port 16*b* in the flow rate control valve 16. Specifically, the line L5 represents the opening surface area between the first pump path 33 and the first cylinder path 31. The line L6 in FIG. 6 represents the opening surface area between the first cylinder port 16*b* and the first adjustment port 16*c*. Specifically, the line L6 represents the opening surface area between the first cylinder path 31 and the first pilot path 55. The line L7 represents the opening surface area between the first bypass port 16*d* and the first adjustment port 16*c* in the flow rate control valve 16.

Specifically, the line L7 represents the opening surface area between the first pump path 33 and the first pilot path 55.

The control of the flow rate control valve 16 represented by the lines L5 and L6 is the same as the abovementioned control of the flow rate control valve 16 represented by the lines L3 and L4 in the second embodiment, and thus an explanation is omitted.

As illustrated by the line L7, the flow rate control valve 16 is switched from the first position state P1 to the third position state P3 when the operation amount of the operating member 46*a* becomes greater than the prescribed operation range in the hydraulic drive system 3 according to the present embodiment. The first pump path 33 and the first pilot path 55 are connected when the flow rate control valve 16 is in the third position state P3. As a result, the hydraulic pressure of the first pump path 33 is input into the first pilot port 53*a* in the first unloading valve 53. Therefore, the differential hydraulic pressure between the first pilot port 53*a* and the second pilot port 53*b* of the first unloading valve 53 becomes zero. As a result, the first unloading valve 53 shuts off communication between the first pump path 33 and the first adjustment path 51 due to the biasing force of the elastic member 53*c*. The first pump path 33 and the first cylinder path 31 are connected when the flow rate control valve 16 is in the third position state P3. As a result, the hydraulic fluid discharged from the first hydraulic pump 12 and the second hydraulic pump 13 is supplied to the first cylinder path 31 without being supplied to the first adjustment path 51.

Other configurations and controls in the hydraulic drive system 3 are the same as those of the hydraulic drive system 1 of the first embodiment and the hydraulic drive system 2 of the second embodiment, and thus explanations thereof are omitted.

The hydraulic drive system 3 according to the present embodiment has the same characteristics as the hydraulic drive system 1 of the first embodiment. The hydraulic drive system 3 according to the present embodiment has the same characteristics as the hydraulic drive system 2 of the second embodiment. The hydraulic drive system 3 according to the present embodiment further includes the following characteristics.

The first pilot path 55 is connected to the first pump path 33 and communication between the first cylinder path 31 and the first pilot path 55 is shut off when the operation amount of the operating member 46*a* becomes greater than the prescribed operation range. As a result, communication between the first pump path 33 and the first adjustment path 51 can be shut off by the first unloading valve 53 regardless of the hydraulic pressure in the first cylinder path 31. Therefore, communication between the first pump path 33 and the first adjustment path 51 can be shut off at an appropriate timing regardless of the size of a load applied to the hydraulic cylinder 14.

While characteristics and controlling by the pump controller 24 when the hydraulic cylinder 14 is expanded has been described herein, the characteristics and controlling by the pump controller 24 when the hydraulic cylinder 14 is contracted is the same as described above.

4. Fourth Embodiment

Figure 7:
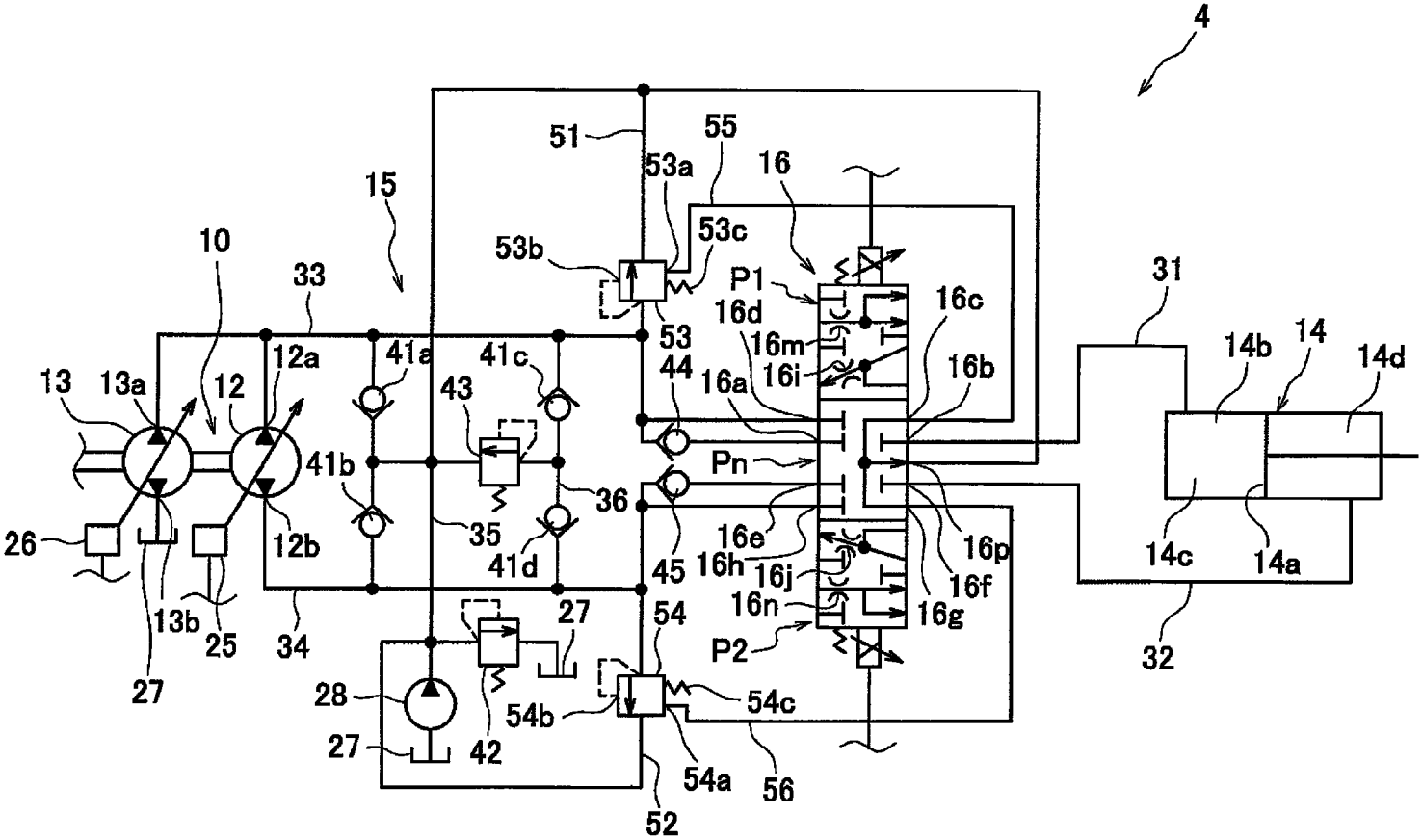
FIG. 7 is a block diagram of a configuration of a hydraulic drive system according to a fourth embodiment of the present invention.

Next, a hydraulic drive system 4 according to a fourth embodiment of the present invention will be described. FIG. 7 is a block diagram of a configuration of a hydraulic drive system 4 according to the fourth embodiment. Configurations in FIG. 7 that are the same as the first to third embodiments are given the same reference numbers as in the first to third embodiment.

The first adjustment path 51 and the second adjustment path 52 are each connected to the charge path 35 in the hydraulic drive system 4. The flow rate control valve 16 includes a charge port 16*p*. The charge port 16*p* is connected to the charge path 35.

In the first position state P1, the flow rate control valve 16 allows the first pump port 16*a* to communicate with the first cylinder port 16*b* and the first adjustment port 16*c* via the restriction 16*m*, and allows the second cylinder port 16*f* and the second adjustment port 16*g* to communicate with the second bypass port 16*h* via a restriction 16*i*. Therefore, the flow rate control valve 16 connects the first pump path 33 to the first cylinder path 31 via the first directional control unit 44 and the restriction 16*m*, and connects the first cylinder path 31 to the first pilot path 55 in the first position state P1. The flow rate control valve 16 connects the second cylinder path 32 and the second pilot path 56 to the second pump path 34 via the restriction 16*i* while bypassing the second directional control unit 45. The first bypass port 16*d*, the charge port 16*p*, and the second pump port 16*e* are all shut off when the flow rate control valve 16 is in the first position state P1.

In the second position state P2, the flow rate control valve 16 allows the second pump port 16*e* to communicate with the second cylinder port 16*f* and the second adjustment port 16*g* via the restriction 16*n*, and allows the first cylinder port 16*b* and the first bypass port 16*c* to communicate with the first bypass port 16*d* via a restriction 16*j*. Therefore, the flow rate control valve 16 connects the second pump path 34 to the second cylinder path 32 via the second directional control unit 45 and the restriction 16*n*, and connects the second cylinder path 32 and the second pilot path 56 in the second position state P2. The flow rate control valve 16 connects the first cylinder path 31 and the first pilot path 55 to the first pump path 33 via the restriction 16*j* while bypassing the first directional control unit 44. The second bypass port 16*h*, the charge port 16*p*, and the first pump port 16*a* are all shut off when the flow rate control valve 16 is in the second position state P2.

The flow rate control valve 16 allows communication between the first adjustment port 16*c*, the second adjustment port 16*g*, and the charge port 16*p* in the neutral position state Pn. Therefore, the flow rate control valve 16 connects the first pilot path 55 and the second pilot path 56 to the charge path 35 in the neutral position state Pn. When the flow rate control valve 16 is in the neutral position state Pn, the first pump port 16*a*, the first cylinder port 16*b*, the first bypass port 16*d*, the second pump port 16*e*, the second cylinder port 16*f*, and the second bypass port 16*h* are all shut off.

Other control functions and configurations of the hydraulic drive system 4 are the same as those of the hydraulic drive systems 1 to 3 in the first to third embodiments and thus explanations thereof are omitted.

When the flow rate control valve 16 returns to the neutral position state Pn due to the operating member 46*a* being returned to the neutral position, the return to the neutral position (0 cc/rev) may not be achieved due to a delay in the response of the tilt angle of the first hydraulic pump 12 and/or the second hydraulic pump 13. The first pilot path 55 and the second pilot path 56 are connected to the charge path 35 when the flow rate control valve 16 is in the neutral position state Pn in the hydraulic drive system 4 according to the present embodiment. As a result, the pressure in the first pump path 33 or the second pump path 34 does not rise to or above the pressure determined by the charge pressure and the elastic members 53*c* and 54*c* of the unloading valves 53 and 54. Therefore, the occurrence of high pressure in the first pump path 33 or the second pump path 34 when the operating member 46*a* is returned to the neutral position can be prevented.

When the flow rate control valve 16 is in the first position state P1, the hydraulic pressure on the upstream side, that is, the hydraulic cylinder 14 side, of the restriction 16*i* in the flow rate control valve 16 acts on the first pilot port 54*a* of the second unloading valve 54. In this case, the hydraulic pressure of the first pilot port 54*a* is higher than the hydraulic pressure of the second pilot port 54*b* in the second unloading valve 54 and thus the second unloading valve 54 is closed. As a result, return hydraulic fluid from the second chamber 14*d* of the hydraulic cylinder 14 is not exhausted from the second unloading valve 54 to the second adjustment path 52. Specifically, since the full amount of the return hydraulic fluid is supplied to the first hydraulic pump 12, the energy regeneration amount is large.

When the flow rate control valve 16 is in the second position state P2, the hydraulic pressure on the upstream side, that is, the hydraulic cylinder 14 side, of the restriction 16*j* in the flow rate control valve 16 acts on the first pilot port 53*a* of the first unloading valve 53. In this case, the hydraulic pressure of the first pilot port 53*a* is higher than the hydraulic pressure of the second pilot port 53*b* in the first unloading valve 53 and thus the first unloading valve 53 is closed. As a result, the return hydraulic fluid from the first chamber 14*c* of the hydraulic cylinder 14 is not exhausted from the first unloading valve 53 to the first adjustment path 51. Specifically, since the full amount of the return hydraulic fluid is supplied to the first hydraulic pump 12 and the second hydraulic pump 13, the energy regeneration amount is large.

5. Fifth Embodiment

Figure 8:
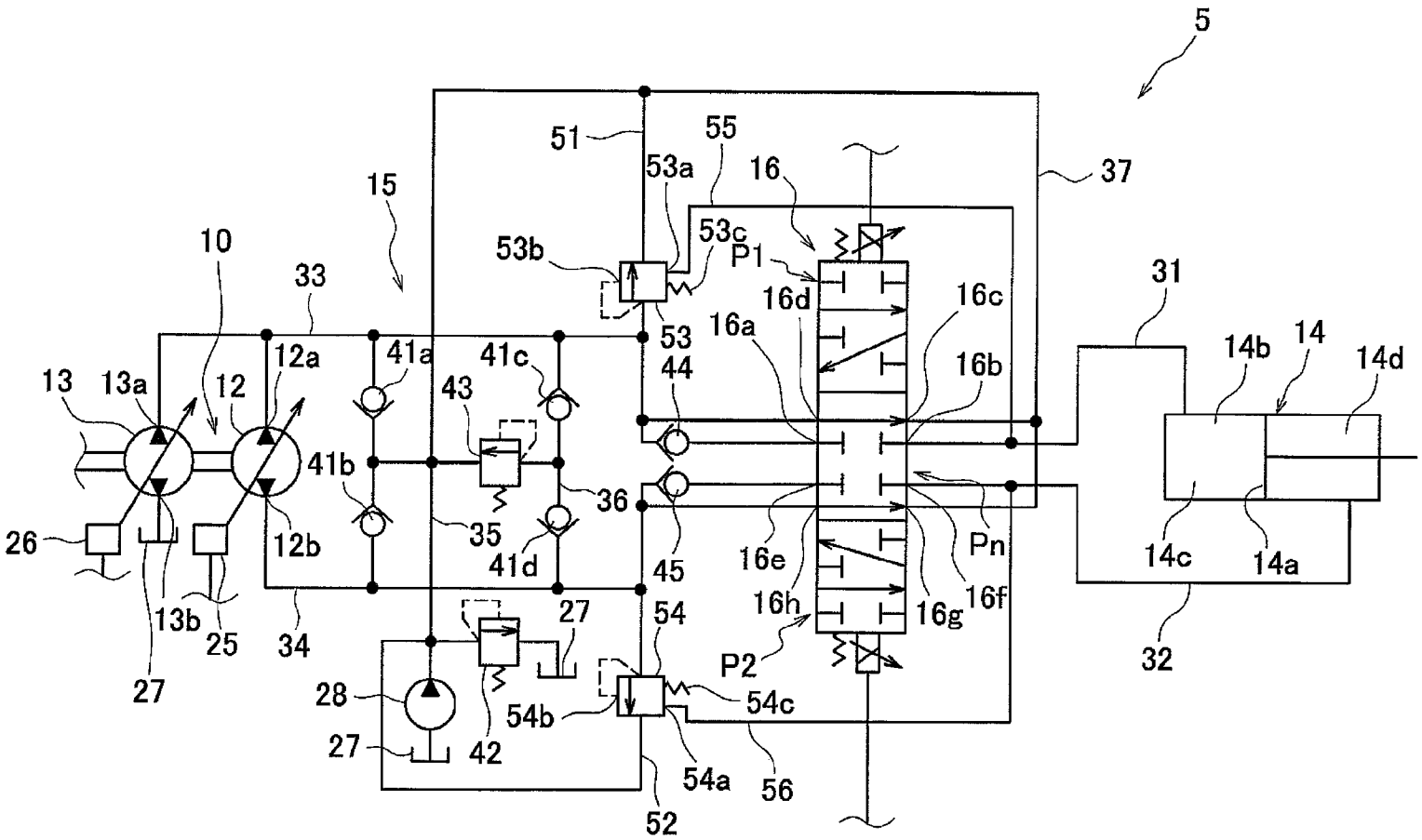
FIG. 8 is a block diagram of a configuration of a hydraulic drive system according to a fifth embodiment of the present invention.

Next, a hydraulic drive system 5 according to a fifth embodiment of the present invention will be described. FIG. 8 is a block diagram of a configuration of a hydraulic drive system according to the fifth embodiment. Configurations in FIG. 8 that are the same as the first to fourth embodiments are given the same reference numbers as in the first to fourth embodiments.

The first pilot path 55 in the hydraulic drive system 5 is connected to the first cylinder path 31. The second cylinder path 56 is connected to the second cylinder path 32.

The flow rate control valve 16 allows communication between the first bypass port 16*d* and the first adjustment port 16*c*, and between the second bypass port 16*h* and the second adjustment port 16*g* in the neutral position state Pn. Therefore, the flow rate control valve 16 connects the first pump path 33 to the adjustment path 37 while bypassing the first directional control unit 44, and connects the second pump path 34 to the adjustment path 37 while bypassing the second directional control unit 45 in the neutral position state Pn. When the flow rate control valve 16 is in the neutral position state Pn, the first pump port 16*a*, the first cylinder port 16*b*, the second pump port 16*e*, and the second cylinder port 16*f* are all shut off.

Figure 9:
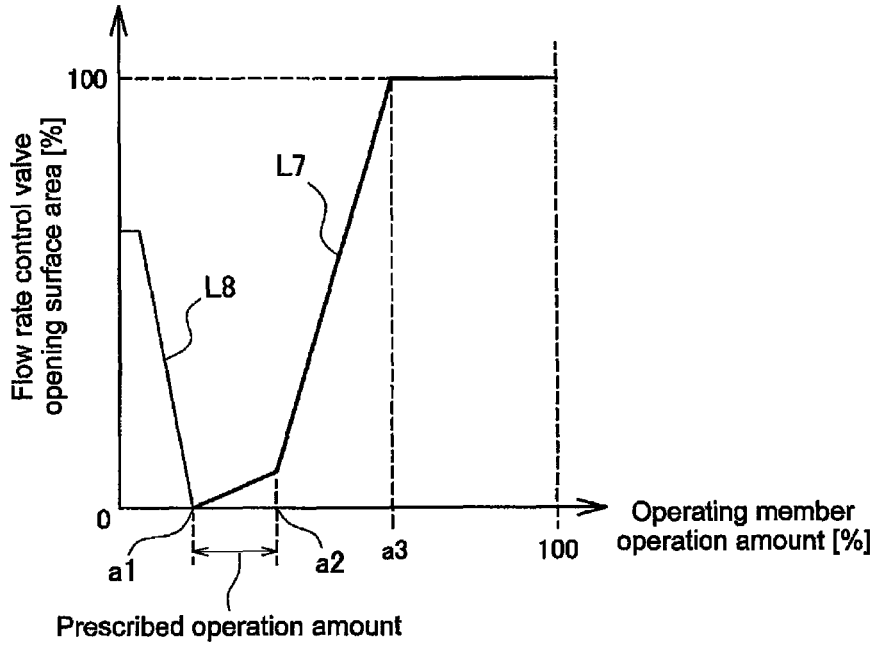
FIG. 9 is a graph illustrating control of a flow rate control valve in the hydraulic drive system according to the fifth embodiment.

FIG. 9 is a graph illustrating changes in the opening surface area of the flow rate control valve 16 with respect to the operation amount of the operating member 46*a*. The line L7 in FIG. 9 represents the opening surface area between the first pump port 16*a* and the first cylinder port 16*b* in the flow rate control valve 16. Specifically, the line L7 represents the opening surface area between the first pump path 33 and the first cylinder path 31. The line L8 represents the opening surface area between the first bypass port 16*d* and the first adjustment port 16*c* in the flow rate control valve 16. Specifically, the line L8 represents the opening surface area between the first pump path 33 and the adjustment path 37. As illustrated in FIG. 9, an opening between the first pump path 33 and the adjustment path 37 is closed when an opening (see operation amount a1) between the first pump path 33 and the first cylinder path 31 is open in the flow rate control valve 16.

Other controls and configurations of the hydraulic drive system 5 are the same as those of the hydraulic drive systems 1 to 4 in the first to fourth embodiments and thus explanations thereof are omitted.

The provision of a port for connecting the first pilot path 55 and the second pilot path 56 in the flow rate control valve 16 is not necessary in the hydraulic drive system 5 according to the present embodiment. As a result, the flow rate control valve 16 can be made in a compact manner.

When the first pilot path 55 is connected to the first cylinder path 31 and the second pilot path 56 is connected to the second cylinder path 32, a holding pressure of the hydraulic cylinder 14 acts on the first pilot port 53*a* of the first unloading valve 53 or on the first pilot port 54*a* of the second unloading valve 54 when the flow rate control valve 16 is returned to the neutral position state Pn. In this case, there is a possibility that the pressure in the first pump path 33 or the second pump path 34 rises to or above the pressure determined by the holding pressure and the elastic members 53*c* and 54*c* of the unloading valves 53 and 54.

However, the first pump path 33 and the second pump path 34 are connected to the charge path 35 via the adjustment path 37 when the flow rate control valve 16 is in the neutral position state Pn in the hydraulic drive system 5 according to the present embodiment. Therefore, the occurrence of high pressure in the first pump path 33 or the second pump path 34 when the operating member 46*a* is returned to the neutral position can be prevented.

Figure 10:
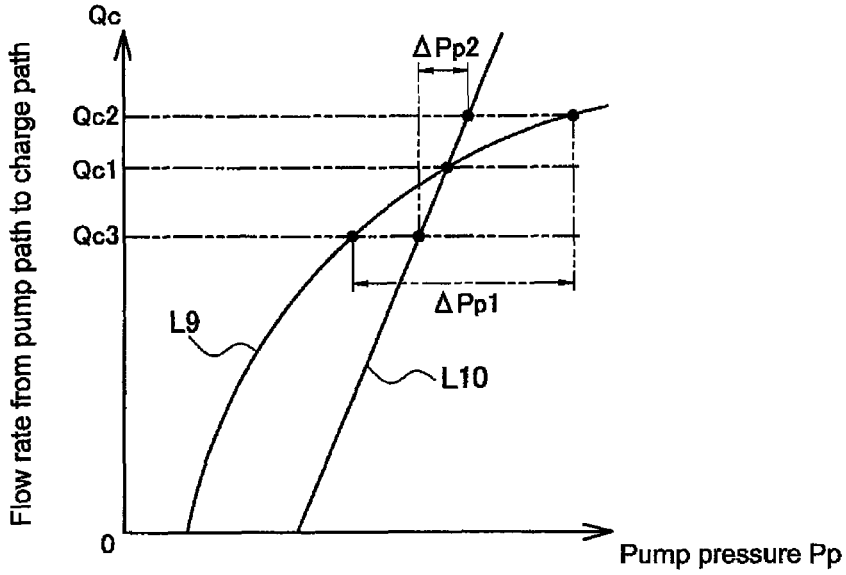
FIG. 10 illustrates differences in properties of a flow rate control valve and an unloading valve.

The micro-speed control can be performed by the unloading valves 53 and 54 in the hydraulic drive system 5 according to the present embodiment. FIG. 10 illustrates differences in properties of the flow rate control valve 14 and the unloading valve 53 and 54. The line L9 in FIG. 10 represents a relationship between the hydraulic pressure of the first pump path 33 and the flow rate of the hydraulic fluid supplied from the first pump path 33 to the charge path 35 in the flow rate control valve 14. Alternatively, the line L9 in FIG. 10 may also represent a relationship between the hydraulic pressure of the second pump path 34 and the flow rate of the hydraulic fluid supplied from the second pump path 34 to the charge path 35 in the flow rate control valve 14. The line L10 represents a relationship between the hydraulic pressure of the first pump path 33 and the flow rate of the hydraulic fluid supplied from the first pump path 33 to the charge path 35 in the first unloading valve 53. Alternatively, the line L10 may also represent a relationship between the hydraulic pressure of the second pump path 34 and the flow rate of the hydraulic fluid supplied from the second pump path 34 to the charge path 35 in the second unloading valve 54.

The actual discharge flow rate of the hydraulic pumps 12 and 13 may deviate from the target flow rate due to the tolerances of the pump-flow-rate control units 25 and 26 during the micro-speed control of the hydraulic cylinder 14. For example, it is assumed in FIG. 10 that Qc1 is the target flow rate and the actual discharge flow rate fluctuates between Qc2 and Qc3. In this case, a fluctuation ΔPp2 of the pump pressure in the unloading valves 53 and 54 is smaller than a fluctuation ΔPp1 of the pump pressure in the flow rate control valve 16. Therefore, the fluctuating range of the pump pressure can be reduced more when using the unloading valves 53 and 54 to perform the micro-speed control than using the flow rate control valve 16 to perform the micro-speed control. Therefore, deviation in the speed of the hydraulic cylinder 14 can be minimized during the micro-speed control.

6. Other Embodiments

Although embodiments of the present invention has been described so far, the present invention is not limited to the above embodiments and various modifications may be made within the scope of the invention.

Figure 11:
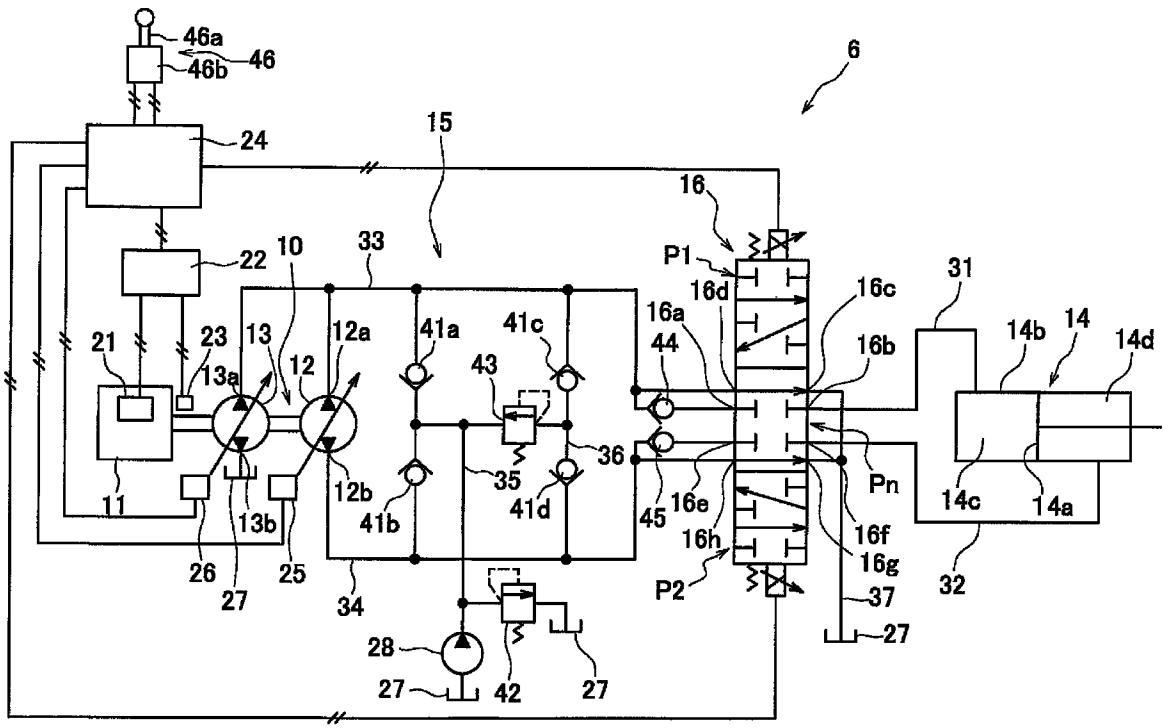
FIG. 11 is a block diagram of a configuration of a hydraulic drive system according to another embodiment of the present invention.

The adjustment path 37 is connected to the charge path 35 in the first embodiment. However, the adjustment path 37 may be connected to the hydraulic fluid tank 27 as illustrated in a hydraulic drive system 6 in FIG. 11. In this case, the excess hydraulic fluid when the operation amount of the operating member 46*a* is within the prescribed operation range is fed to the hydraulic fluid tank 27.

Figure 12:
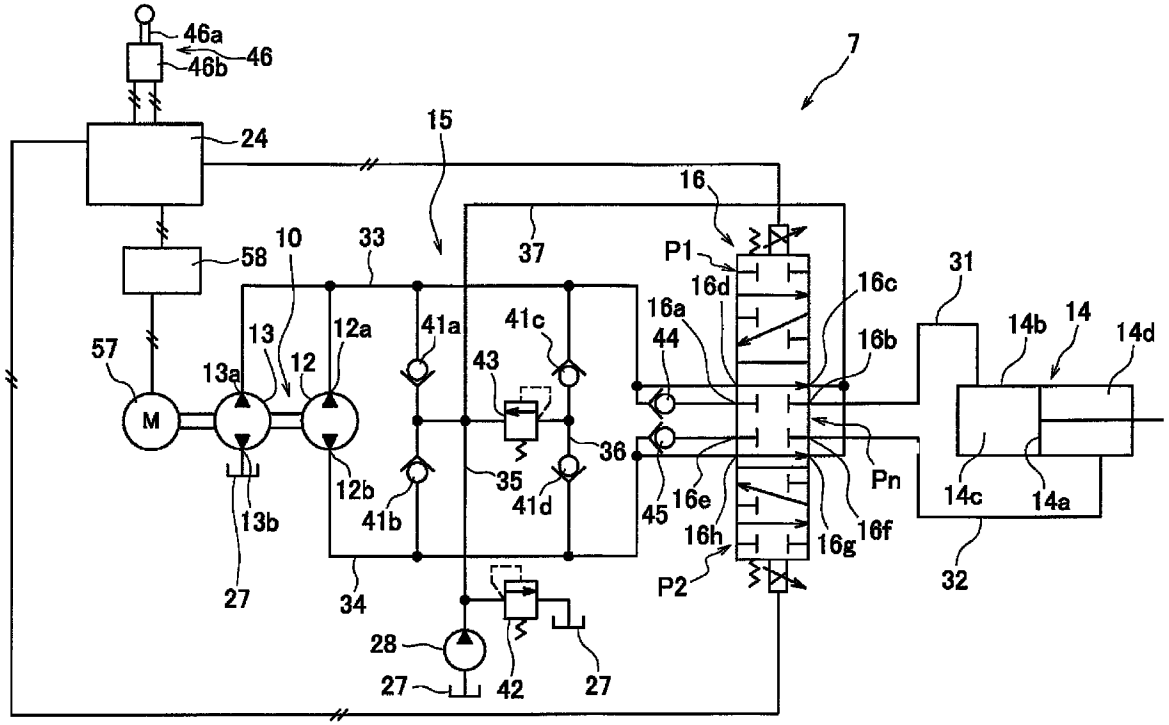
FIG. 12 is a block diagram of a configuration of a hydraulic drive system according to another embodiment of the present invention.

The pump-flow-rate control units 25 and 26 control the discharge flow rate of the hydraulic pumps 12 and 13 by controlling the tilt angles of the hydraulic pumps 12 and 13 in the first embodiment. However, the pump-flow-rate control unit of the present invention may control the discharge flow rate of the hydraulic pumps by controlling the rotation speed of the hydraulic pumps. For example, an electric motor 57 may be used as a driving source as illustrated in the hydraulic drive system 7 in FIG. 12. In this case, the pump-flow-rate control unit may be a drive circuit 58 for controlling the rotation speed of the electric motor 57. When the operation amount of the operating member 46*a* is zero, the pump controller 24 stops the electric motor 57 and stops the rotation of the hydraulic pumps 12 and 13. When the operation amount of the operating member 46*a* is within the prescribed operation range, the pump controller 24 controls the rotation speeds of the hydraulic pumps 12 and 13 so that the discharge flow rate of the hydraulic pumps 12 and 13 is equal to or greater than the target flow rate corresponding to the operation amount of the operating member 46*a* by controlling the rotation speed of the electric motor 57. When the operation amount of the operating member 46*a* is greater than the prescribed operation range, the pump controller 24 controls the rotation speeds of the hydraulic pumps 12 and 13 so that the discharge flow rate of the hydraulic pumps 12 and 13 meets the target flow rate corresponding to the operation amount of the operating member 46*a* by controlling the rotation speed of the electric motor 57.

The tank port 16*t* is connected to the hydraulic fluid tank 27 in the second and third embodiments. However, the tank port 16*t* may be connected to the charge path 35. In this case, the capacity of the charge pump 28 can be reduced.

Figure 13:
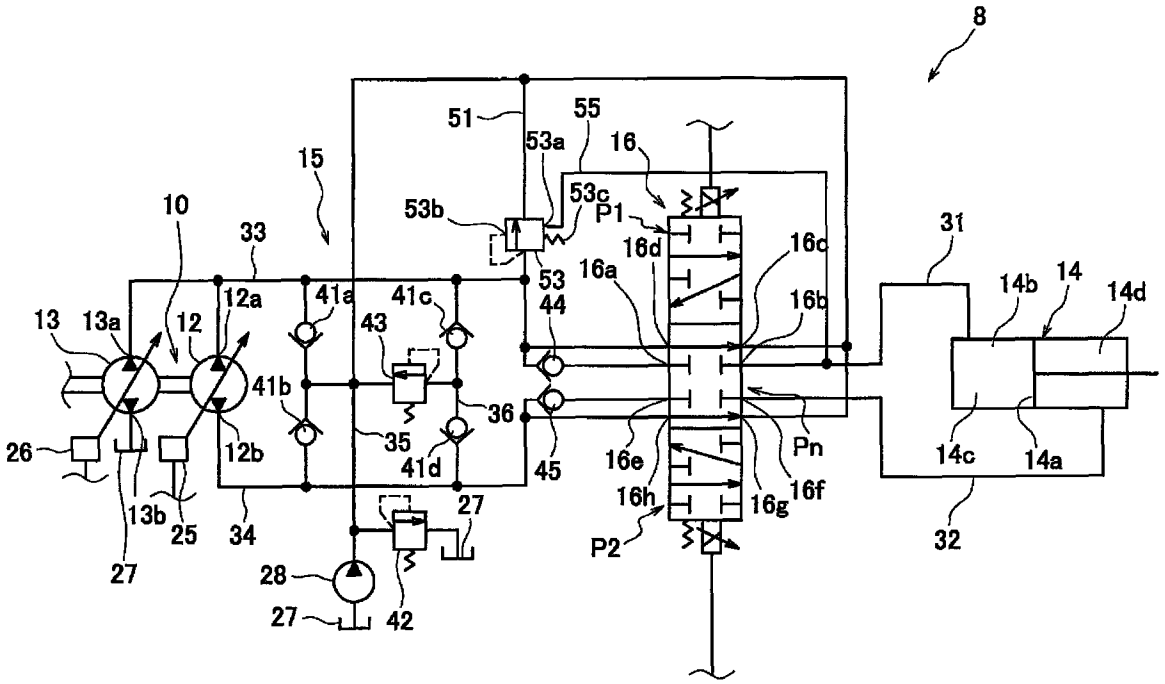
FIG. 13 is a block diagram of a configuration of a hydraulic drive system according to another embodiment of the present invention.

The hydraulic drive system 5 according to the fifth embodiment includes the first unloading valve 53 and the second unloading valve 54. However, only the first unloading valve 53 may be provided in a hydraulic drive system 8 as illustrated in FIG. 13. As a result, the hydraulic drive system 8 can be made in a compact manner.

The target flow rate setting unit is the operating member 46*a* in the above embodiments. However, the target flow rate setting unit of the present invention may be a computing unit for computing the target flow rate in accordance with conditions such as driving conditions.

When the operation amount of the operating member 46*a* is greater than the prescribed operation range, that is, the target flow rate is greater than the prescribed range in the above embodiments, the opening degree of the path in the flow rate control valve 16 for allowing the hydraulic pumps and the hydraulic cylinder 14 to communicate is fully open. Here, "fully open" may not correspond to the structural maximum opening degree of the flow rate control valve 16. For example, "fully open" may correspond to a maximum opening degree in the usage range of the flow rate control valve 16 during normal control.

While the present invention is applicable to a twin pump hydraulic drive system in which two hydraulic pumps 12 and 13 are connected to the hydraulic cylinder 14 in the above embodiments, the present invention may also be applicable to a single pump hydraulic drive system in which one hydraulic pump is connected to the hydraulic cylinder 14.

While the micro-speed control is determined by using the operation amount of the operating member 46*a* as a parameter corresponding to the target flow rate in the above embodiments, the micro-speed control may also be determined directly from the target flow rate. Specifically, "the operation amount of the operating member 46*a*" may be replaced with "target flow rate", and the "prescribed operation range" may be replaced with a "prescribed range" corresponding to the prescribed operation range in the above embodiments.

While the unloading valve is exemplified as an example of the adjustment flow rate control unit of the present invention in the above embodiments, various types of devices for controlling the flow rate of the hydraulic fluid in accordance with a differential hydraulic pressure may be used.

While the check valve is exemplified as one example of the directional control unit in the present invention in the above embodiments, various types of devices may be used so long as the direction of the flow of the hydraulic fluid is restricted to one direction.

While the flow rate control valve 16 is an electromagnetic control valve in the above embodiments, the flow rate control valve 16 may be a hydraulic pressure control valve controlled by pilot hydraulic pressure. In this case, an electromagnetic proportional pressure-reducing valve is disposed between the pump controller 24 and the hydraulic pressure control valve. The electromagnetic proportional pressure-reducing valve is controlled by command signals from the pump controller 24. The electromagnetic proportional pressure-reducing valve supplies pilot hydraulic pressure to the hydraulic pressure control valve in accordance with command signals. The hydraulic pressure control valve is controlled by switching according to pilot hydraulic pressure. The electromagnetic proportional pressure-reducing valve reduces the pressure of the hydraulic fluid discharged from the pilot pump to generate pilot hydraulic pressure. Hydraulic fluid discharged from the charge pump 28 may also be used in place of hydraulic fluid discharged from the pilot pump.

According to the present invention, micro-speed control of the hydraulic cylinder is enabled in a hydraulic drive system equipped with a hydraulic closed circuit.

What is claimed is:

1. A hydraulic driving system comprising:

a hydraulic pump;

a driving source configured to drive the hydraulic pump;

a hydraulic cylinder configured to be driven by hydraulic fluid discharged from the hydraulic pump;

a hydraulic fluid path forming a closed circuit between the hydraulic pump and the hydraulic cylinder, the hydraulic fluid path including an adjustment path supplied with hydraulic fluid from the hydraulic pump, a pump path connected to the hydraulic pump, a cylinder path connected to the hydraulic cylinder, and a pilot path;

a pump-flow-rate control unit configured to control a discharge flow rate of the hydraulic pump in response to a first command signal;

an adjustment flow rate control unit arranged and configured to control a flow rate of hydraulic fluid supplied to the adjustment path from the hydraulic pump, the adjustment flow rate control unit including a pilot port connected to the pilot flow path, the adjustment flow rate control unit being further configured to allow communication between the pump path and the adjustment path when a differential hydraulic pressure between the pump path and the pilot path is greater than a prescribed set pressure, and shut off communication between the hydraulic pump and the adjustment path when the differential hydraulic pressure between the pump path and the pilot path is equal to or less than the prescribed set pressure;

a flow rate control valve arranged to provide an adjustable opening degree in the hydraulic fluid path between the hydraulic pump and the hydraulic cylinder, the flow rate control valve being arranged and configured to connect the pump path to the cylinder path and to connect the cylinder path to the pilot path, the flow rate control valve being configured to control a flow rate of hydraulic fluid supplied to the hydraulic cylinder from the hydraulic pump by varying the opening degree of the flow rate control valve in response to a second command signal;

a directional control unit configured to allow a flow of hydraulic fluid from the hydraulic pump to the hydraulic cylinder and prohibit a flow of hydraulic fluid from the hydraulic cylinder to the hydraulic pump when hydraulic fluid is supplied from the hydraulic pump to the hydraulic cylinder via the flow rate control valve; and a controller configured to control the flow rate of hydraulic fluid supplied to the hydraulic cylinder from the hydraulic pump based on a target flow rate by controlling the flow rate control valve using the second command signal when the target flow rate is within a prescribed range, and controlling the pump-flow-rate control unit using the first command signal when the target flow rate is greater than the prescribed range, the controller being further configured such that when the target flow rate is within the prescribed range, the controller controls the pump-flow-rate control unit to set a discharge flow rate of the hydraulic pump to a flow rate greater than the target flow rate such that hydraulic fluid from the hydraulic pump is divided between the hydraulic cylinder and the adjustment path, a differential hydraulic pressure between the pump path and the cylinder path being greater than the prescribed set pressure when the target flow rate is within the prescribed range, and the differential hydraulic pressure between the pump path and the cylinder path being equal to or less than the prescribed set pressure when the target flow rate is greater than the prescribed range.

2. The hydraulic drive system according to claim 1, wherein the controller fully opens the flow rate control valve to allow communication between the hydraulic pump and the hydraulic cylinder when the target flow rate is greater than the prescribed range.

3. The hydraulic drive system according to claim 1, wherein when the target flow rate is greater than the prescribed range, the pump-flow-rate control unit sets a discharge flow rate of the hydraulic pump to the target flow rate, and a path between the adjustment path and the hydraulic pump in the hydraulic fluid path is closed.

4. The hydraulic drive system according to claim 1, wherein the flow rate control valve is configured to control a flow rate of hydraulic fluid supplied from the hydraulic pump to the hydraulic cylinder and a flow rate of hydraulic fluid supplied from the hydraulic pump to the adjustment path.

5. The hydraulic drive system according to claim 4, wherein the hydraulic fluid path further includes a pump path connected to the hydraulic pump, and a cylinder path connected to the hydraulic cylinder, and the flow rate control valve includes a pump port connected to the pump path via the directional control unit, a cylinder port connected to the cylinder path, and an adjustment port connected to the adjustment path.

6. The hydraulic drive system according to claim 5, further comprising:

a hydraulic fluid tank configured to store the hydraulic fluid, the adjustment path being connected between the hydraulic fluid tank and the pump path, a pressure relief valve being connected between the pump path and the adjustment path.

7. The hydraulic drive system according to claim 1, further comprising:

a charge pump configured to replenish hydraulic fluid to the hydraulic pump, the hydraulic fluid path further including a charge path connecting the charge pump and the hydraulic pump, and the adjustment path being connected to the charge path.

8. The hydraulic drive system according to claim 1, further comprising:

a charge pump configured to replenish hydraulic fluid to the hydraulic pump, the hydraulic fluid path further including a charge path connecting the charge pump and the hydraulic pump, and the flow rate control valve shutting off communication between the pump path and the cylinder path and connecting the pilot path to the charge path in a neutral position state.

9. The hydraulic drive system according to claim 1, further comprising an operating member configured to be operated by an operator, wherein the hydraulic pump is a variable displacement pump, the pump-flow-rate control unit controls the discharge flow rate of the hydraulic pump by controlling a tilt angle of the hydraulic pump, the controller sets the target flow rate based on an operation amount of the operating member, when the operation amount of the operating member is zero, the controller sets the tilt angle of the hydraulic pump to zero, and when the operation amount of the operating member is within a prescribed operation range corresponding to the prescribed range of the target flow rate, the controller controls the tilt angle of the hydraulic pump so that the discharge flow rate of the hydraulic pump meets or exceeds the target flow rate corresponding to the operation amount of the operating member.

10. The hydraulic drive system according to claim 1, further comprising an operating member configured to be operated by an operator, wherein the pump-flow-rate control unit controls the discharge flow rate of the hydraulic pump by controlling a rotation speed of the hydraulic pump, the controller sets the target flow rate based on an operation amount of the operating member, when the operation amount of the operating member is zero, the controller stops rotation of the hydraulic pump, and when the operation amount of the operating member is within a prescribed operation range corresponding to the prescribed range of the target flow rate, the controller controls the rotation speed of the hydraulic pump so that the discharge flow rate of the hydraulic pump meets or exceeds the target flow rate corresponding to the operation amount of the operating member.

11. The hydraulic drive system according to claim 1, wherein the hydraulic pump includes a first pump port and a second pump port, the hydraulic pump is switchable between a state of drawing in hydraulic fluid from the second pump port and discharging hydraulic fluid from the first pump port, and a state of drawing in hydraulic fluid from the first pump port and discharging hydraulic fluid from the second pump port, the hydraulic cylinder includes a first chamber and a second chamber, and the hydraulic cylinder expands and contracts by switching supply and exhaust of the hydraulic fluid between the first chamber and the second chamber, the pump path of the hydraulic fluid path includes a first pump path connected to the first pump port and a second pump path connected to the second pump port, and the cylinder path of the hydraulic fluid path includes a first cylinder path connected to the first chamber and a second cylinder path connected to the second chamber, the directional control unit has a first directional control unit and a second directional control unit, the first directional control unit is configured to allow flow of hydraulic fluid from the first pump path to the first cylinder path and to prohibit flow of hydraulic fluid from the first cylinder path to the first pump path when hydraulic fluid is supplied from the first pump path to the first cylinder path by the flow rate control valve, the second directional control unit is configured to allow flow of hydraulic fluid from the second pump path to the second cylinder path and to prohibit flow of hydraulic fluid from the second cylinder path to the second pump path when the hydraulic fluid is supplied from the second pump path to the second cylinder path by the flow rate control valve, the flow rate control valve is switchable between a first position state and a second position state, the flow rate control valve connects the first pump path to the first cylinder path via the first directional control unit, and connects the second cylinder path to the second pump path while bypassing the second directional control unit in the first position state, and the flow rate control valve connects the first cylinder path to the first pump path while bypassing the first directional control unit, and connects the second pump path to the second cylinder path via the second directional control unit in the second position state.

12. A hydraulic driving system comprising:

a hydraulic pump;

a driving source configured to drive the hydraulic pump;

a hydraulic cylinder configured to be driven by hydraulic fluid discharged from the hydraulic pump;

a hydraulic fluid path forming a closed circuit between the hydraulic pump and the hydraulic cylinder, the hydraulic fluid path including an adjustment path supplied with hydraulic fluid from the hydraulic pump, a pump path connected to the hydraulic pump, a cylinder path connected to the hydraulic cylinder, and a pilot path;

a pump-flow-rate control unit configured to control a discharge flow rate of the hydraulic pump in response to a first command signal;

an adjustment flow rate control unit arranged and configured to control a flow rate of hydraulic fluid supplied to the adjustment path from the hydraulic pump, the adjustment flow rate control unit including a pilot port connected to the pilot flow path, the adjustment flow rate control unit being further configured to allow communication between the pump path and the adjustment path when a differential hydraulic pressure between the pump path and the pilot path is greater than a prescribed set pressure, and shut off communication between the hydraulic pump and the adjustment path when the differential hydraulic pressure between the pump path and the pilot path is equal to or less than the prescribed set pressure;

a flow rate control valve arranged to provide an adjustable opening degree in the hydraulic fluid path between the hydraulic pump and the hydraulic cylinder, the flow rate control valve being arranged and configured to connect the pump path to the cylinder path and to connect the cylinder path to the pilot path, the flow rate control valve being configured to control a flow rate of hydraulic fluid supplied to the hydraulic cylinder from the hydraulic pump by varying the opening degree of the flow rate control valve in response to a second command signal;

a directional control unit configured to allow a flow of hydraulic fluid from the hydraulic pump to the hydraulic cylinder and prohibit a flow of hydraulic fluid from the hydraulic cylinder to the hydraulic pump when hydraulic fluid is supplied from the hydraulic pump to the hydraulic cylinder via the flow rate control valve; and a controller configured to control the flow rate of hydraulic fluid supplied to the hydraulic cylinder from the hydraulic pump based on a target flow rate by controlling the flow rate control valve using the second command signal when the target flow rate is within a prescribed range, and controlling the pump-flow-rate control unit using the first command signal when the target flow rate is greater than the prescribed range, the controller being further configured such that when the target flow rate is within the prescribed range, the controller controls the pump-flow-rate control unit to set a discharge flow rate of the hydraulic pump to a flow rate greater than the target flow rate such that hydraulic fluid from the hydraulic pump is divided between the hydraulic cylinder and the adjustment path, a differential hydraulic pressure between the pump path and the cylinder path when the target flow rate is within the prescribed range being greater than the prescribed set pressure, the controller being further configured to control the flow rate control valve such that pump path is connected to the cylinder path, and the cylinder path is connected to the pilot path when the target flow rate is within the prescribed range, and control the flow rate control valve such that the pump path is connected to the cylinder path, and the pilot path is connected to the pump path when the target flow rate is greater than the prescribed range.

13. A hydraulic driving system comprising:

a hydraulic pump;

a driving source configured to drive the hydraulic pump;

a hydraulic cylinder configured to be driven by hydraulic fluid discharged from the hydraulic pump;

a hydraulic fluid path forming a closed circuit between the hydraulic pump and the hydraulic cylinder, the hydraulic fluid path including an adjustment path supplied with hydraulic fluid from the hydraulic pump, a pump path connected to the hydraulic pump, a cylinder path connected to the hydraulic cylinder, and a pilot path connected to the cylinder path;

a pump-flow-rate control unit configured to control a discharge flow rate of the hydraulic pump in response to a first command signal;

an adjustment flow rate control unit configured to control a flow rate of hydraulic fluid supplied from the hydraulic pump to the adjustment path, the adjustment flow rate control unit including a pilot port connected to the pilot flow path, the adjustment flow rate control unit being further configured to allow communication between the pump path and the adjustment path when a differential hydraulic pressure between the pump path and the pilot path is greater than a prescribed set pressure, and shut off communication between the hydraulic pump and the adjustment path when the differential hydraulic pressure between the pump path and the pilot path is equal to or less than the prescribed set pressure;

a flow rate control valve arranged to provide an adjustable opening degree in the hydraulic fluid path between the hydraulic pump and the hydraulic cylinder, the flow rate control valve being arranged and configured to connect the pump path to the cylinder path and to connect the cylinder path to the pilot path, the flow rate control valve being configured to control a flow rate of hydraulic fluid supplied to the hydraulic cylinder from the hydraulic pump by varying the opening degree of the flow rate control valve in response to a second command signal;

a directional control unit configured to allow a flow of hydraulic fluid from the hydraulic pump to the hydraulic cylinder and prohibit a flow of hydraulic fluid from the hydraulic cylinder to the hydraulic pump when hydraulic fluid is supplied from the hydraulic pump to the hydraulic cylinder via the flow rate control valve; and a controller configured to control the flow rate of hydraulic fluid supplied to the hydraulic cylinder from the hydraulic pump based on a target flow rate by controlling the flow rate control valve using the second command signal when the target flow rate is within a prescribed range, and controlling the pump-flow-rate control unit using the first command signal when the target flow rate is greater than the prescribed range, the controller being further configured such that when the target flow rate is within the prescribed range, the controller controls the pump-flow-rate control unit to set a discharge flow rate of the hydraulic pump to a flow rate greater than the target flow rate such that hydraulic fluid from the hydraulic pump is divided between the hydraulic cylinder and the adjustment path, a differential hydraulic pressure between the pump path and the cylinder path when the target flow rate is within the prescribed range being greater than the prescribed set pressure, and the differential hydraulic pressure between the pump path and the cylinder path when the target flow rate is greater than the prescribed range being equal to or less than the prescribed set pressure.

14. The hydraulic drive system according to claim 13, wherein the flow rate control valve shuts off communication between the pump path and the cylinder path and connects the pump path to the adjustment path in a neutral position state.

15. The hydraulic drive system according to claim 14, wherein when an opening of the flow rate control valve between the pump path and the cylinder path is open, an opening between the pump path and the adjustment path is closed.

* * * * *